US012551023B1

(12) United States Patent
Gregory

(10) Patent No.: US 12,551,023 B1
(45) Date of Patent: Feb. 17, 2026

(54) MODULAR SOFA SLEEPER HAVING PIVOTAL BACKREST ASSEMBLY

(71) Applicant: L&P Property Management Company, South Gate, CA (US)

(72) Inventor: Brett Gregory, Glendale, KY (US)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 18/806,959

(22) Filed: Aug. 16, 2024

(51) Int. Cl.
*A47C 17/165* (2006.01)
*A47C 17/207* (2006.01)

(52) U.S. Cl.
CPC ..... *A47C 17/165* (2013.01); *A47C 17/207* (2013.01)

(58) Field of Classification Search
CPC ..... A47C 17/165; A47C 17/207
See application file for complete search history.

(56) References Cited

U.S. PATENT DOCUMENTS

| | | | | |
|---|---|---|---|---|
| 3,906,557 | A | 9/1975 | Barabas | |
| 4,402,096 | A | 9/1983 | Atimichuk | |
| 4,563,037 | A | 1/1986 | Tiffany | |
| 4,586,205 | A | 5/1986 | Stevens | |
| 4,996,730 | A | 3/1991 | Fireman et al. | |
| 6,241,317 | B1 | 6/2001 | Wu | |
| 6,341,392 | B1 | 1/2002 | Makinen | |
| 7,213,885 | B2 | 5/2007 | White, III et al. | |
| 8,209,797 | B2 | 7/2012 | Swierski et al. | |
| 8,739,330 | B2 | 6/2014 | Smith et al. | |
| 9,241,576 | B2 | 1/2016 | Rodriguez | |
| 9,814,321 | B2 | 11/2017 | Garland | |
| 11,083,306 | B1 | 8/2021 | Thompson | |
| 11,234,531 | B2 | 2/2022 | Mabon | |
| 11,903,488 | B1 | 2/2024 | Larsen et al. | |
| 2003/0011231 | A1 | 1/2003 | Guillot | |
| 2008/0189851 | A1 * | 8/2008 | Griepentrog ..... | A47C 17/165 5/43 |

FOREIGN PATENT DOCUMENTS

| | | | |
|---|---|---|---|
| CN | 108209286 | A | 6/2018 |
| CN | 208388238 | U | 1/2019 |
| CN | 220384708 | U | 1/2024 |
| DE | 2443611 | A1 | 3/1976 |
| DE | 29820913 | U1 | 2/1999 |
| GB | 2472853 | A | 2/2011 |
| JP | 10248676 | A | 9/1998 |

* cited by examiner

*Primary Examiner* — Adam C Ortiz
(74) *Attorney, Agent, or Firm* — Wood Herron & Evans LLP

(57) ABSTRACT

A modular sofa sleeper comprises a sofa frame, a pivotal backrest assembly and a bed mechanism which be assembled and disassembled without tools. Each of these components may be shipped separately in boxes. The sofa frame may be shipped as multiple components which may be assembled or disassembled without tools. The sofa frame has at least one stop which limits rotation of the pivotal backrest assembly from its lowered position to its raised position. The bed mechanism is movable between an extended position for the sofa sleeper to function as a bed and a collapsed position for the sofa sleeper to function as a sofa.

18 Claims, 24 Drawing Sheets

MODULAR SOFA SLEEPER HAVING PIVOTAL BACKREST ASSEMBLY

FIELD OF THE INVENTION

This invention relates generally to seating products and, more particularly, to modular sofa sleeper which may be shipped in multiple pieces.

BACKGROUND OF THE INVENTION

Traditionally, sofa sleepers have been manufactured in a factory and shipped to a furniture store for sale to customers. The sofa sleeper traditionally comprises a sofa frame inside which is fixedly attached a foldable sofa bed mechanism comprising multiple sections pivotal relative to each other. The foldable sofa bed mechanism is movable between a fully folded or retracted position and an extended position. When in its retracted position, the foldable sofa bed mechanism fits within the sofa frame and is hidden from view. When in its extended position, the foldable sofa bed mechanism the sections extend outwardly over the front of the sofa frame and form a bed.

In today's world of ecommerce, furniture products which may be ordered online and shipped in boxes are desirable. The smaller the box, the more desirable for the customer, because in general smaller boxes are cheaper to ship. Sofa sleepers present a unique challenge with regards to shipping due to their size and construction. A sofa sleeper which may be shipped in several different boxes and assembled upon delivery would be desirable.

Most sofa sleepers have an internal portion which resides inside a sofa frame when the sofa sleeper is in a sofa position. To convert the sofa sleeper to a bed position from the sofa position, a person pulls a handle to unfold multiple sections of the sofa sleeper which may be heavy and awkward to unfold.

Therefore, there is a need for a modular sofa sleeper which may be shipped in boxes to a customer for assembly.

There is further a need for a sofa sleeper with a pivotal backrest which may be quickly and easily pivoted between positions depending upon whether the sofa sleeper is being used as bed or a sofa.

There is further a need for a sofa sleeper which may be quickly and easily assembled without tools or with minimal tools.

SUMMARY OF THE INVENTION

In a first aspect of the invention, a modular sofa sleeper comprises a sofa frame comprising two arms, a front brace extending between the arms, a rear brace extending between the arms and a stop. The stop extends between the arms between the front and rear braces. The modular sofa sleeper further comprises front and rear tapered mounting brackets secured to each of the arms. The modular sofa sleeper further comprises a backrest assembly movable between a raised position and a lowered position. The backrest assembly comprises two backrest side members, a backrest top member, a backrest middle member and a backrest bottom member. The backrest assembly further comprises spaced backrest slats secured to the backrest top, middle and bottom members. The backrest further comprises rear tapered posts adapted to fit inside the rear tapered mounting brackets. Each of the rear tapered posts is pivotally secured to one of the side members of the backrest assembly. The modular sofa sleeper further comprises a bed mechanism comprising a foot section and a lumbar section hinged together. The bed mechanism is movable between an extended position and a collapsed position. Stationary legs are secured to the foot section. The legs do not change position regardless of the position of the bed mechanism, which is a structural advance because the legs may be stronger than foldable legs. The bed mechanism further comprises front tapered posts adapted to fit inside the front tapered mounting brackets. Each of the front tapered posts is pivotally secured to the lumbar section of the bed mechanism. The backrest may be removed from the sofa frame by removing said rear tapered posts from the rear tapered mounting brackets and the bed mechanism may be removed from the sofa frame by removing the front tapered posts from the front tapered mounting brackets. The backrest assembly may be removed from the sofa frame by removing the rear tapered posts from the rear tapered mounting brackets and the bed mechanism may be removed from the sofa frame by removing the front tapered mounting posts from the front tapered mounting brackets.

According to a second aspect of the invention, a modular sofa sleeper comprises a sofa frame comprising two arms, a front brace extending between the arms, a rear brace extending between the arms and at least one stop. One type of stop extends between the arms between the front and rear braces and is parallel to the front and rear braces. The modular sofa sleeper further comprises front and rear mounting brackets secured to each of the arms. The modular sofa sleeper further comprises a pivotal backrest assembly movable between a raised position and a lowered position. The pivotal backrest assembly abuts the stop of the sofa frame when the pivotal backrest assembly is in the raised position. The modular sofa sleeper further comprises rear posts pivotally secured to the pivotal backrest assembly. Each of the rear posts is adapted to fit inside one of the rear mounting brackets. The modular sofa sleeper further comprises a bed mechanism comprising a foot section and a lumbar section hinged together. The bed mechanism is movable between an extended position and a collapsed position in which the foot section is above the lumbar section. Stationary legs are secured to the foot section. The legs do not change position regardless of the position of the bed mechanism, which is a structural advance because the legs may be stronger than foldable legs. The modular sofa sleeper further comprises front posts adapted to fit inside the front mounting brackets. Each of the front posts is pivotally secured to the bed mechanism. The pivotal backrest may be removed from the sofa frame by removing said rear posts from the rear mounting brackets and the bed mechanism may be removed from the sofa frame by removing the front posts from the front mounting brackets. The backrest assembly is removable from the sofa frame by removing the rear tapered posts from the rear tapered mounting brackets and the bed mechanism is removable from the sofa frame by removing the front tapered mounting posts from the front tapered mounting brackets.

According to a third aspect of the invention, a method of assembling a modular sofa sleeper comprises the following steps. First, the method includes providing a sofa frame comprising two arms, a front brace extending between the arms, a rear brace extending between the arms and a stop. The stop extends between the arms between the front and rear braces and is parallel to the front and rear braces. The modular sofa sleeper further comprises a front tapered mounting bracket and a rear tapered mounting bracket secured to each of the arms.

The assembly method further comprises securing rear tapered posts of a backrest assembly inside the rear mounting brackets of the sofa frame. Each of the rear tapered posts of the backrest assembly is pivotally secured to a side member of the backrest assembly such that the backrest assembly is pivotal between a raised position and a lowered position. The backrest assembly abuts the stop of the sofa frame when the backrest assembly is in the raised position.

The assembly method further comprises securing front tapered posts of the bed mechanism inside the front mounting brackets of the sofa frame. Each of the front tapered posts of the bed mechanism is pivotally secured to a lumbar section of the bed mechanism. The bed mechanism further comprises a foot section hinged to the lumbar section. The bed mechanism is movable between an extended position and a collapsed position in which the foot section is above the lumbar section.

One advantage of the present invention is that modular sofa sleeper may be assembled and disassembled without tools.

Another advantage of the present invention is that the modular sofa sleeper may be shipped in boxes.

The accompanying drawings, which are incorporated in and constitute a part of this specification, illustrate embodiments of the invention and, together with the summary of the invention given above, and the detailed description of the drawings given below, serve to explain the principles of the present invention.

DETAILED DESCRIPTION OF THE INVENTION

Figure 1:
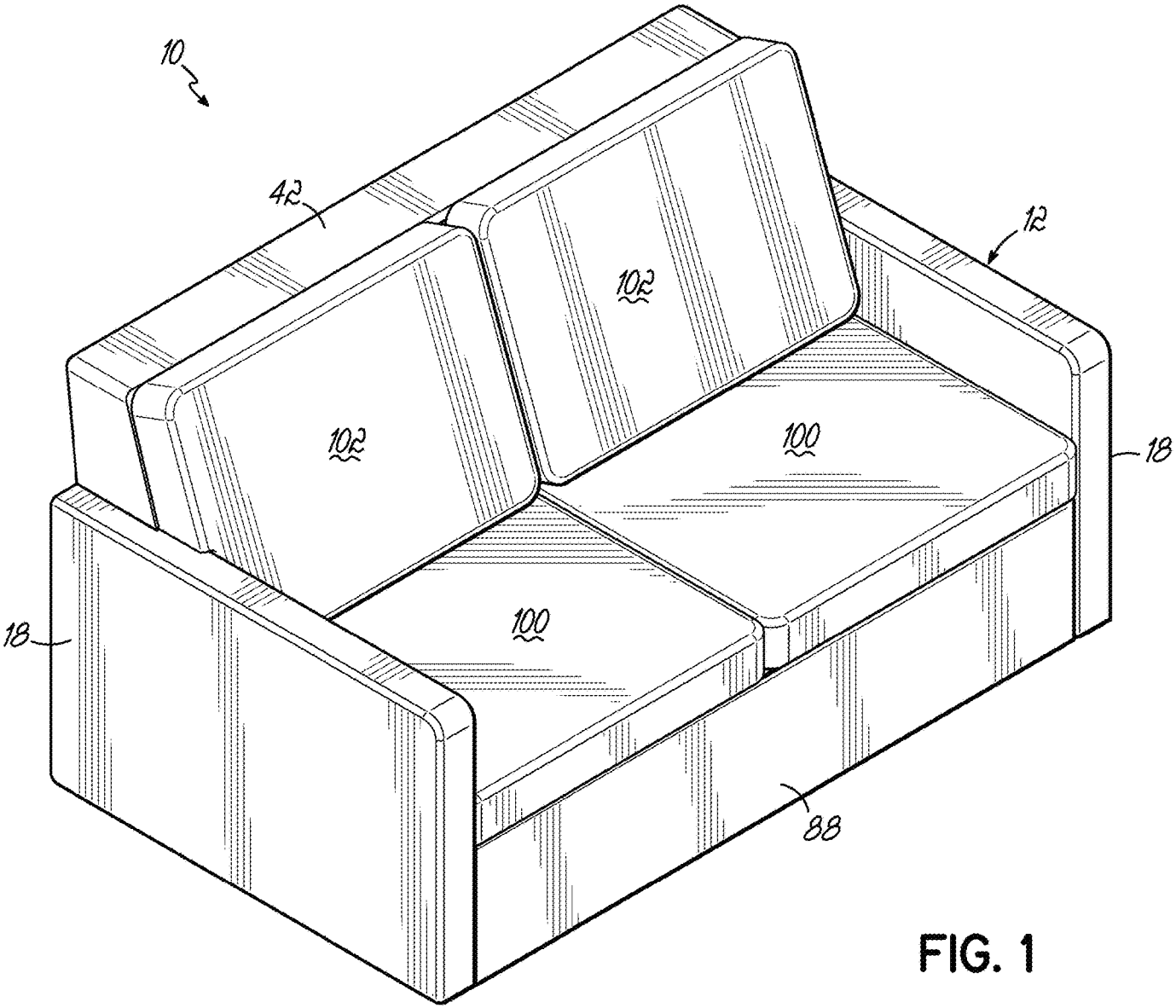
FIG. 1 is a perspective view of a sofa sleeper in a sofa position.

Referring first to FIG. 1, there is illustrated a sofa sleeper 10 incorporating the principles of the present invention. The sofa sleeper 10 is movable between a sofa position shown in FIG. 1 and a bed position shown in FIG. 6D.

Figure 3:
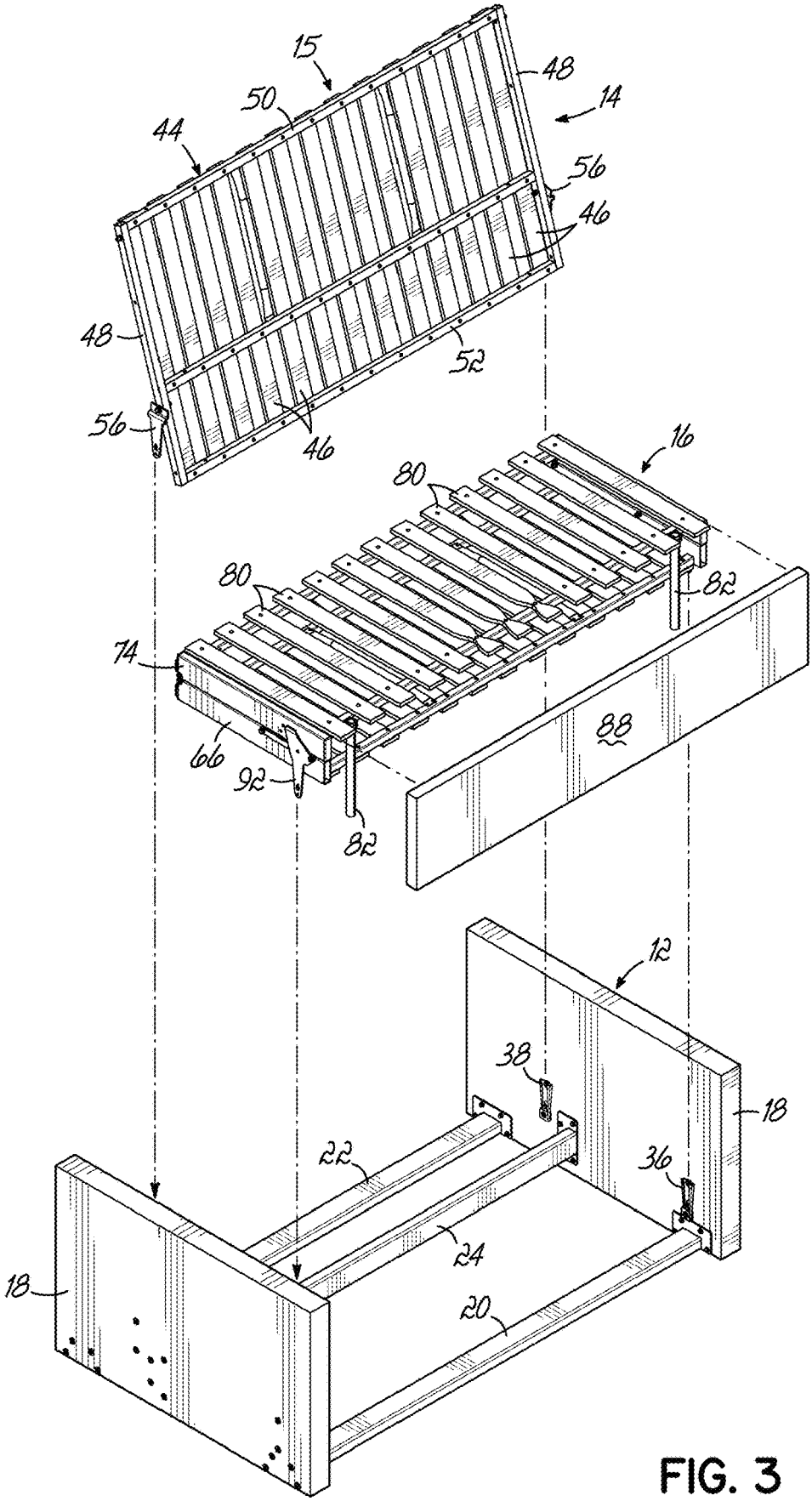
FIG. 3 is a perspective view, partially disassembled, of the sofa sleeper of FIG. 1 showing the assembly of the sofa sleeper.

As best shown in FIG. 3, the sofa sleeper 10 comprises a sofa frame 12, a backrest assembly 14 and a bed mechanism 16. As best shown in FIG. 3, the sofa frame 12 comprises two arms 18, a front brace 20 extending between the arms 18, a rear brace 22 extending between the arms 18 and a stop 24 extending between the arms 18. The stop 24 is between the front and rear braces 20, 22, respectively.

Figure 5A:
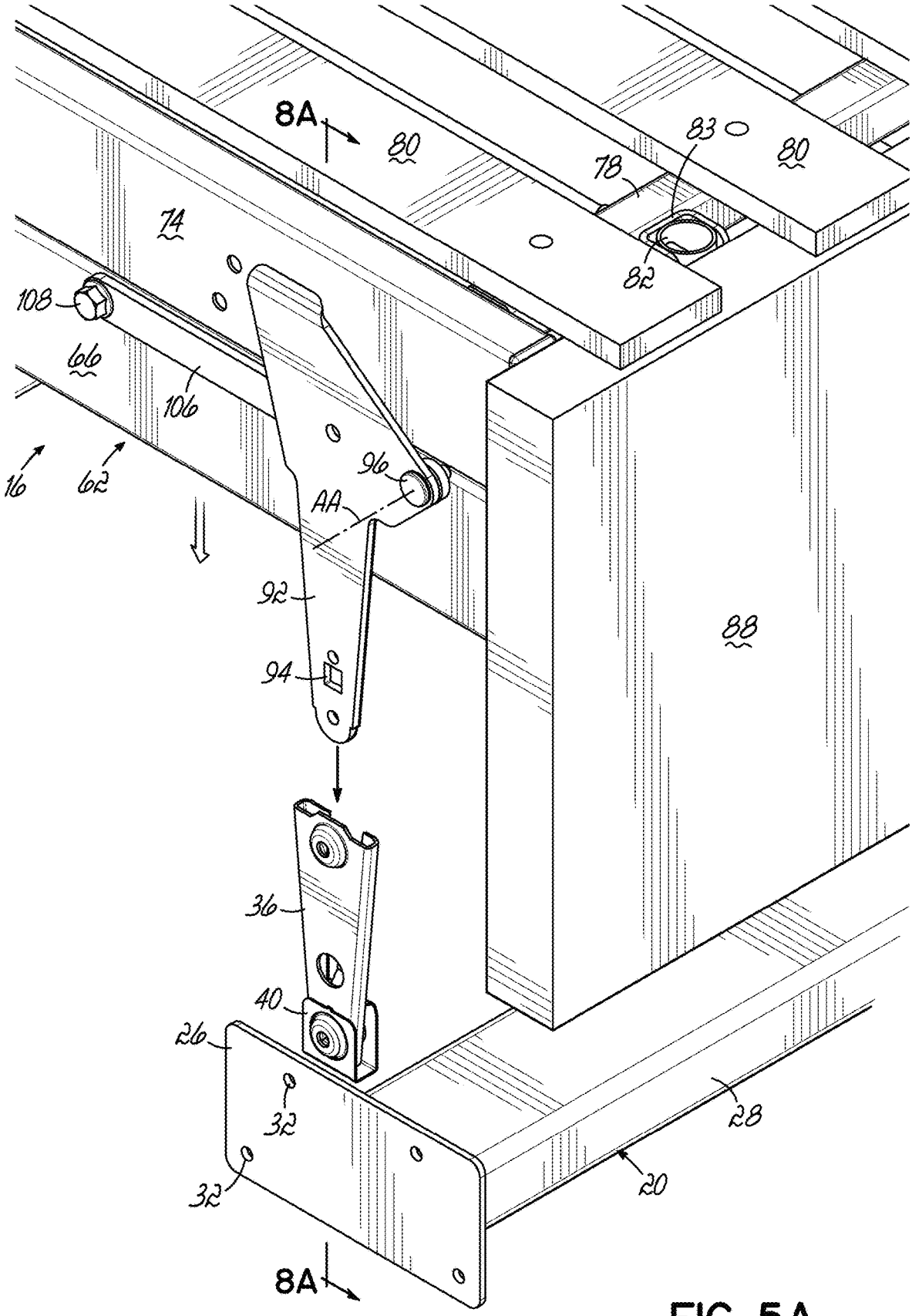
FIG. 5A is an enlarged view of the encircled area of FIG. 4.
Figure 5B:
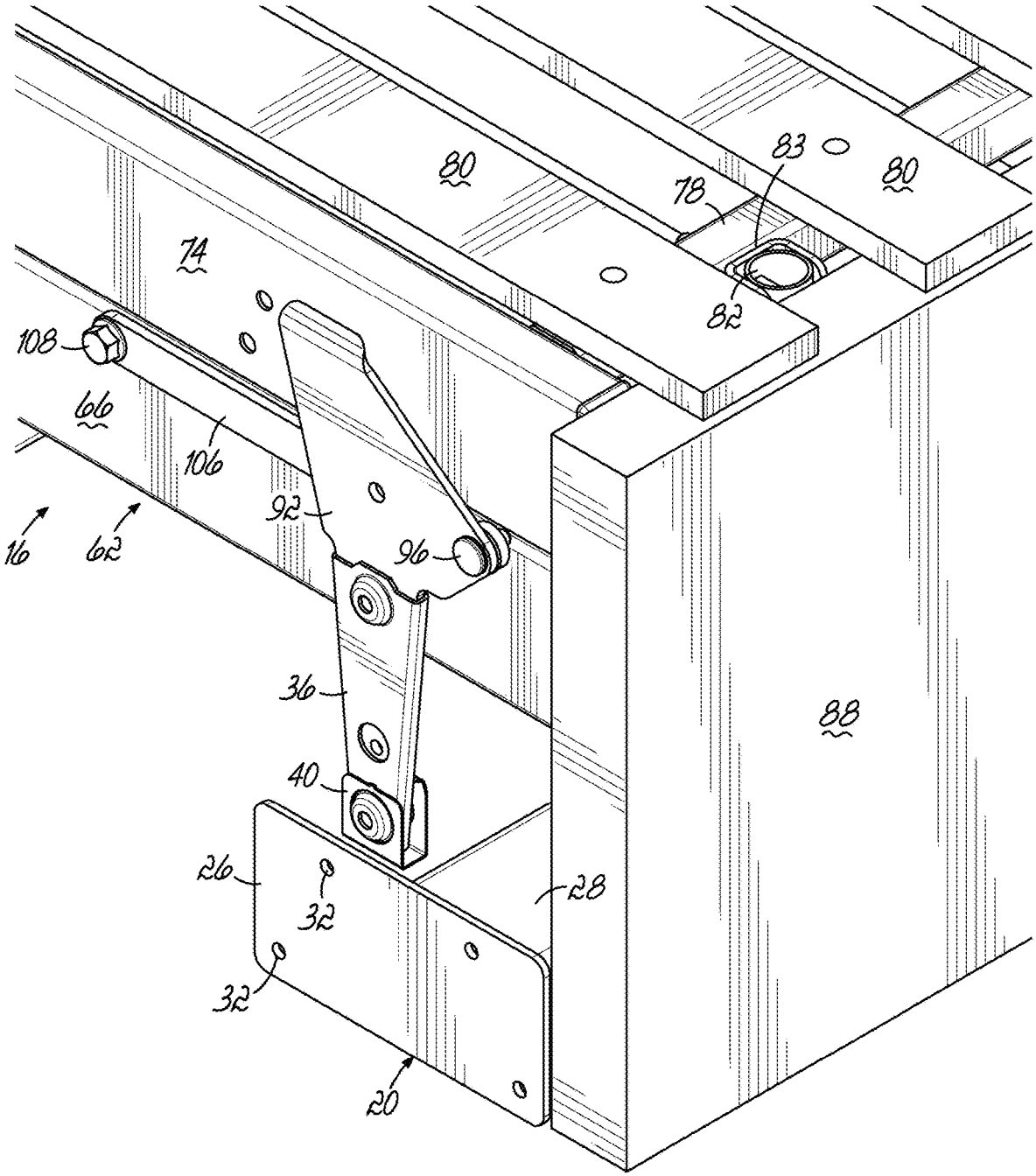
FIG. 5B is an enlarged view of the encircled area of FIG. 4, showing one of the front tapered posts secured inside one of the front tapered mounting brackets.
Figure 8A:
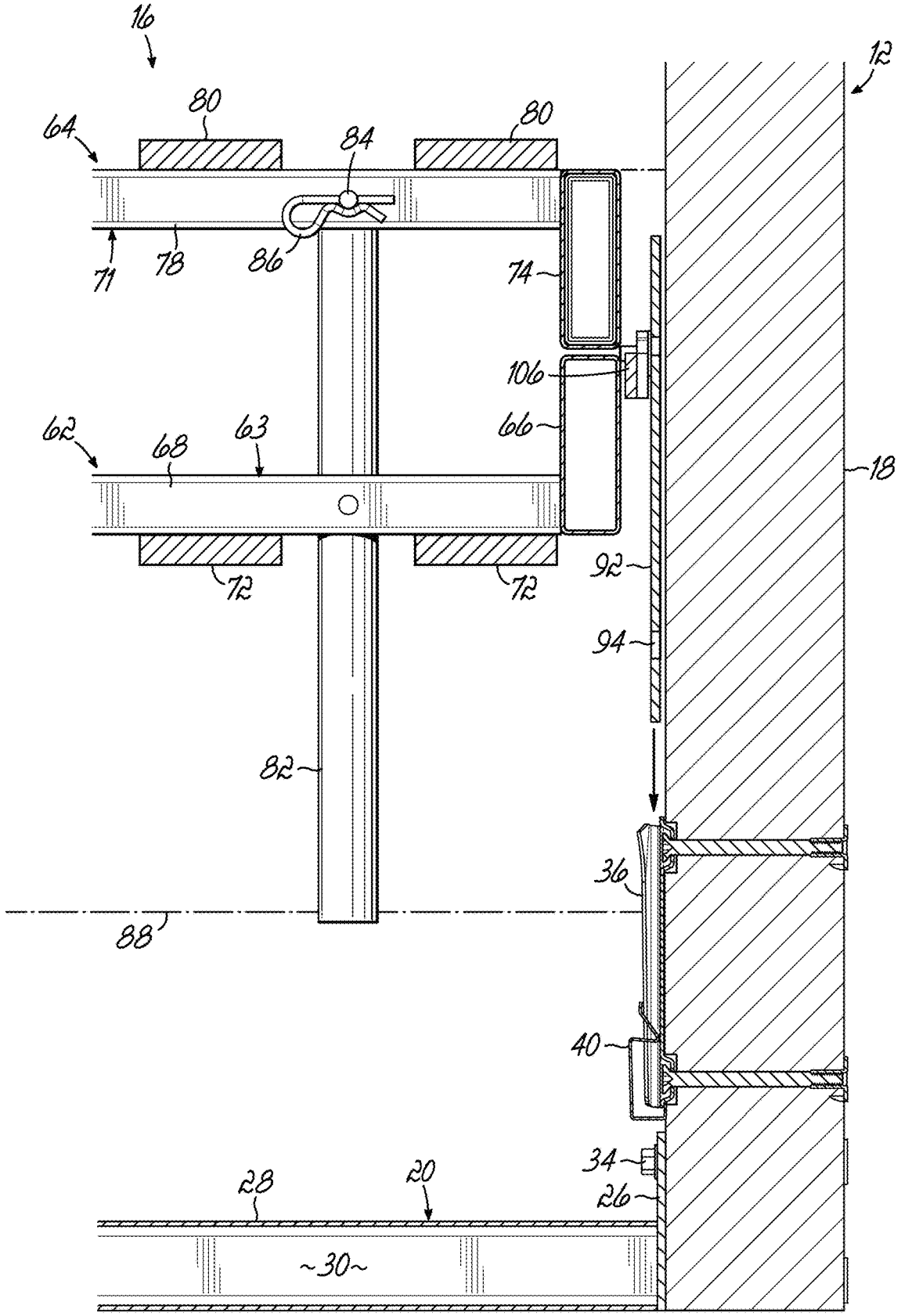
FIG. 8A is a cross-sectional view taken along the line 8A-8A of FIG. 5A.
Figure 8B:
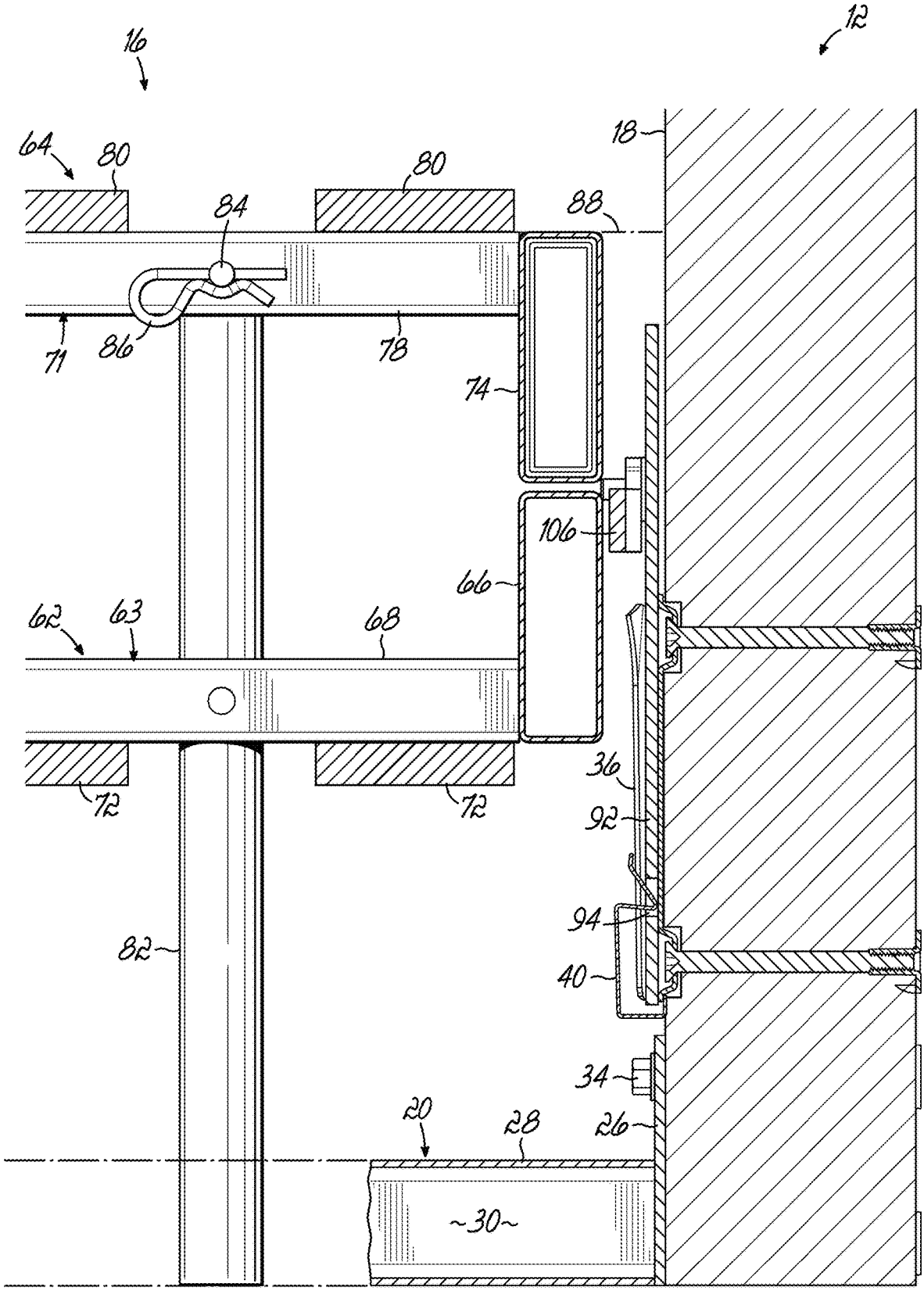
FIG. 8B is a cross-sectional view similar to FIG. 8A but showing the legs on the ground.
Figure 9A:
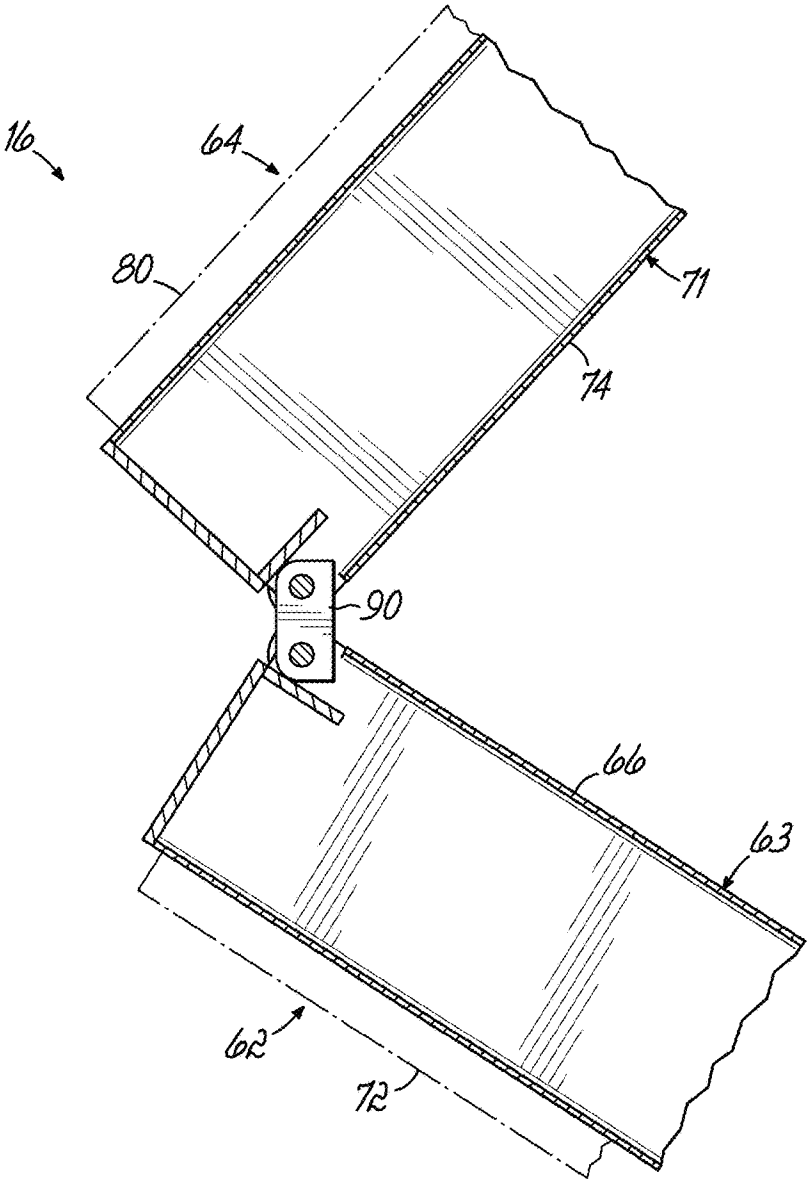
FIG. 9A is a cross-sectional view of the hinge of the bed mechanism as the bed mechanism is being unfolded.
Figure 9B:
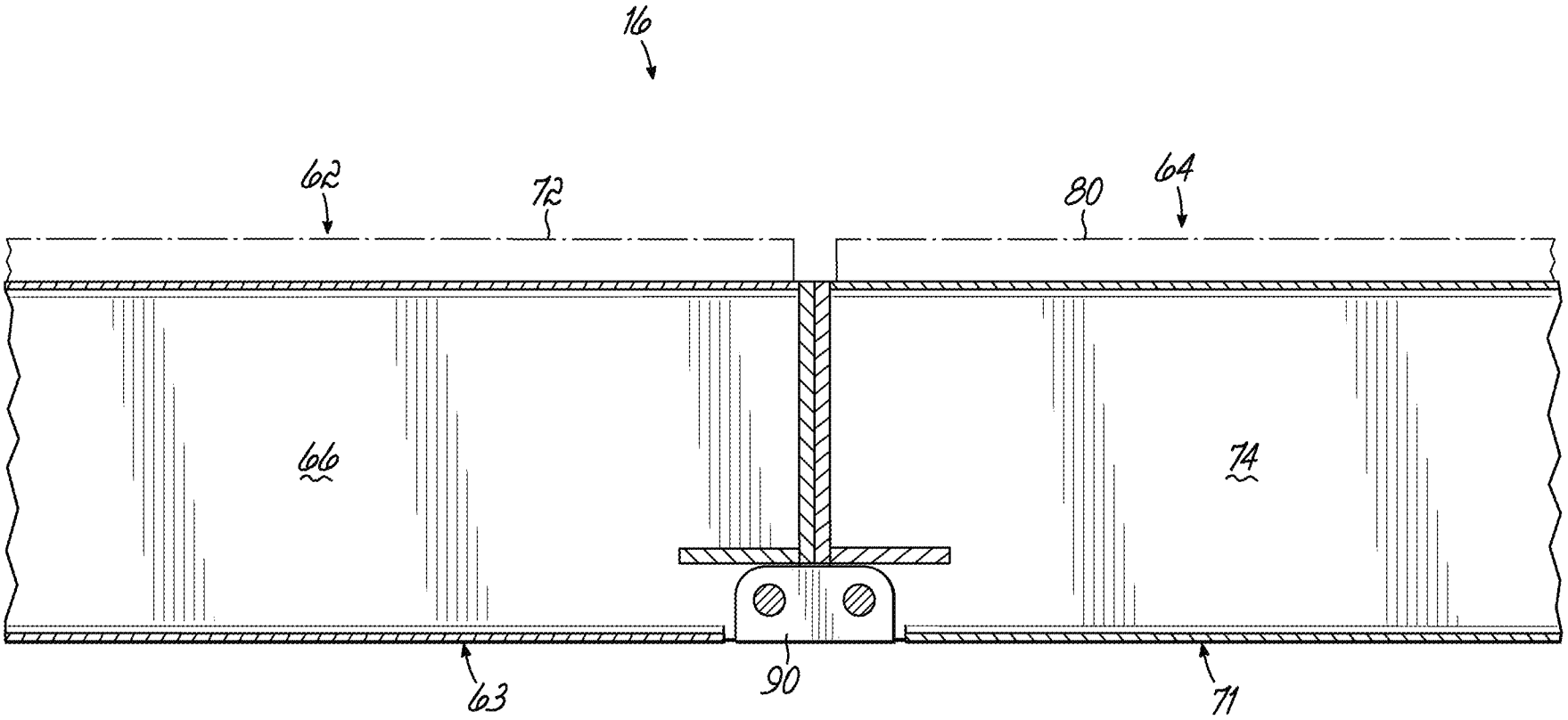
FIG. 9B is a cross-sectional view of the hinge of the bed mechanism showing the bed mechanism fully unfolded.

As best shown in FIGS. 5A, 5B, 8A and 8B, each of the braces 20 and 22 and stop 24 comprises end plates 26 at opposite ends of the respective brace. A straight portion 28 extends between the end plates 26 and has a hollow interior 30. As best shown in FIGS. 5A and 5B, each of the end plates 26 has openings 32 therethrough. As best shown in FIGS. 8A and 8B, fasteners 34 extend through the openings 32 in the end plates 26 and secure the end plate 26 to one of the arms 18.

Although not shown, it is within the scope of the present invention to have the end plates 26 of the braces 20 and 22 and stop 24 fit into receptacles and/or slots of the arms 18 of the sofa frame 12 to avoid the need for fasteners. Alternatively, the braces 20 and 22 and stop 24 may lack end plates and be otherwise secured to portions of the arms 18 of the sofa frame 12 without the need for fasteners and/or without the need for tools and/or with only a few simple fasteners and/or tools.

As best shown in FIG. 3, a front tapered mounting bracket 36 is secured to each of the arms 18 (only one being shown in FIG. 3). Similarly, a rear tapered mounting bracket 38 is secured to each of the arms 18 (only one being shown in FIG. 3). As best shown in FIGS. 5A and 5B, each of the front and rear tapered mounting brackets 36, 38 has a clip 40 at the bottom thereof. Each of the front and rear tapered mounting brackets 36, 38 is stationary regardless of the position of the sofa sleeper 10 or the position of the backrest assembly 14 or the position of the bed mechanism 16.

Although each of the front and rear tapered mounting brackets 36, 38 is shown having a tapered configuration, these mounting brackets need not be tapered. They may be any desired shape or configuration.

Figure 4:
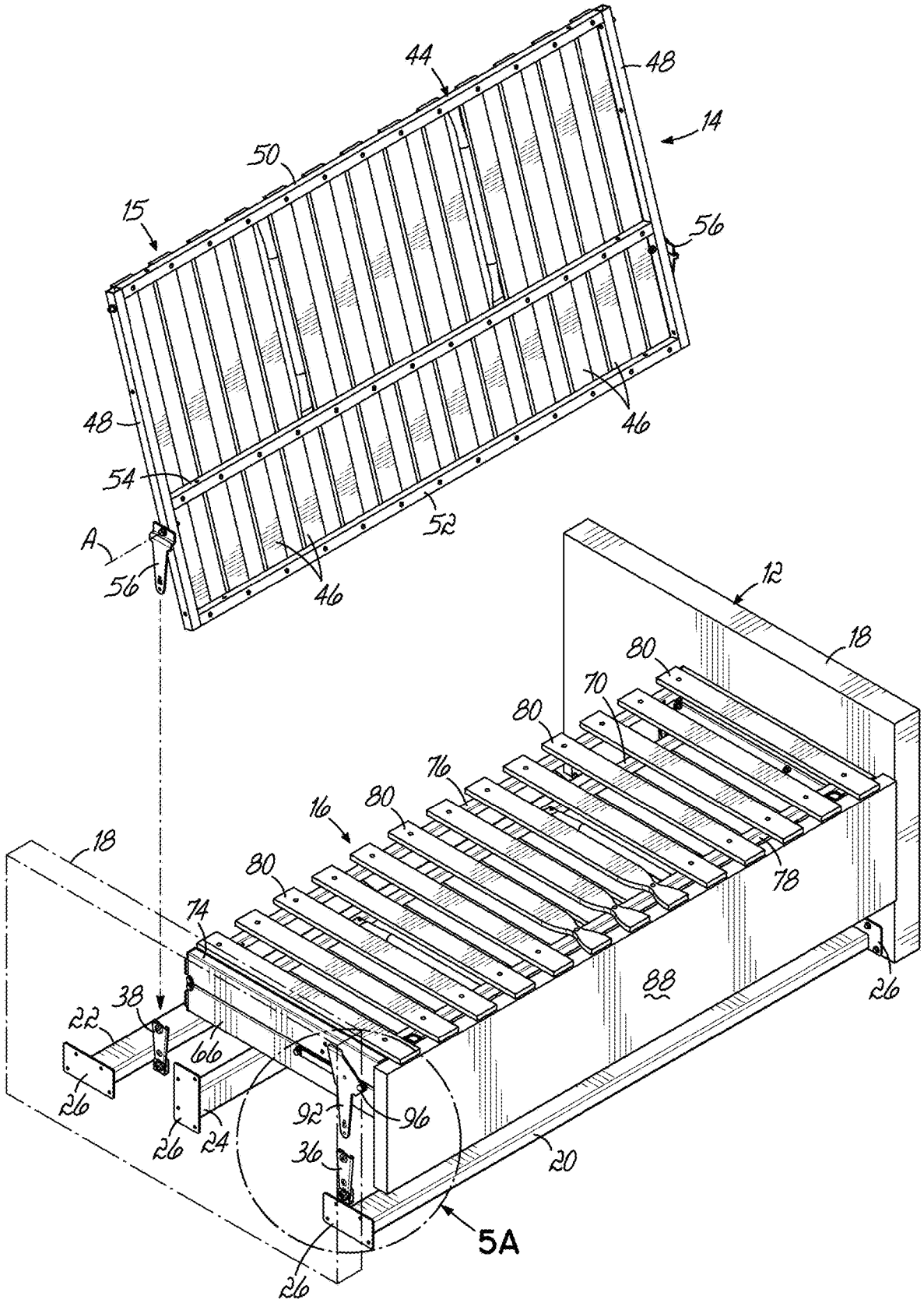
FIG. 4 is a perspective view, partially disassembled, of the sofa sleeper of FIG. 1 further showing the assembly of the sofa sleeper.

As best shown in FIG. 4, the sofa sleeper 10 further comprises a backrest section 15 comprising a backrest assembly 14 comprising a generally rectangular backrest frame 44 to which are secured a plurality of parallel, spaced backrest slats 46. The slats 46 may be made of wood or plastic or any known material. The generally rectangular backrest frame 44 comprises two backrest side members 48, a backrest top member 50, and a backrest bottom member 52. The backrest assembly 14 further comprises a middle member 54 to which each of the backrest slats 46 may be secured.

As best shown in FIG. 4, the backrest assembly 14 further comprises two rear tapered posts 56. Each rear tapered post 56 is adapted to fit inside one of the rear tapered mounting brackets 38 and be locked therein. As seen in FIG. 4, each rear tapered post 56 is pivotally secured to one of the backrest side members 48 of the backrest assembly 14 to pivot about a pivot axis A. The rear tapered posts 56 secure the backrest assembly 14 to the arms 18 of the sofa frame 12 and enable the backrest assembly 14 to pivot about pivot axis A between its raised and lowered positions described herein.

Figure 6A:
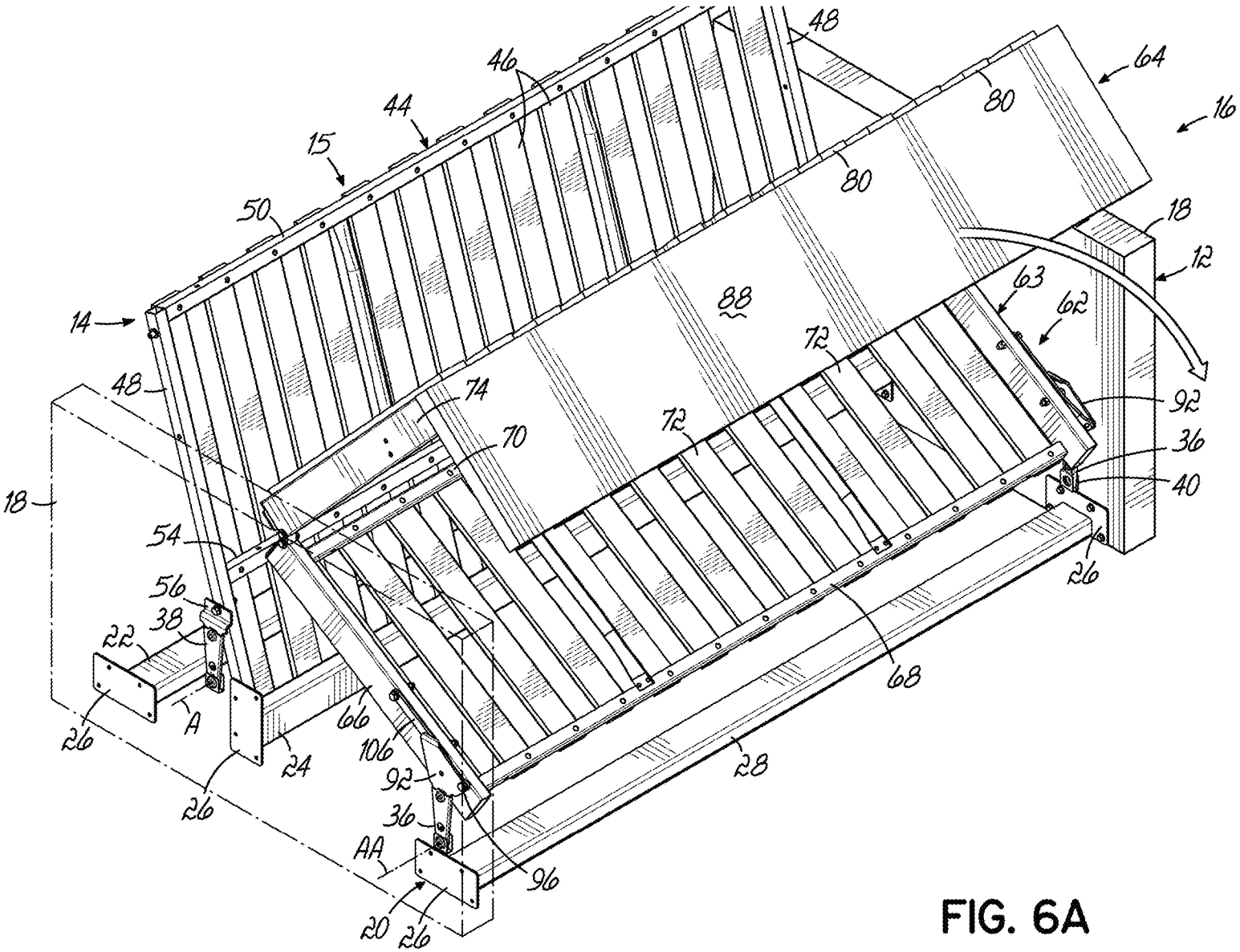
FIG. 6A is a perspective view, partially broken away, of the sofa sleeper of FIG. 1 being moved from a sofa position to a bed position.
Figure 6B:
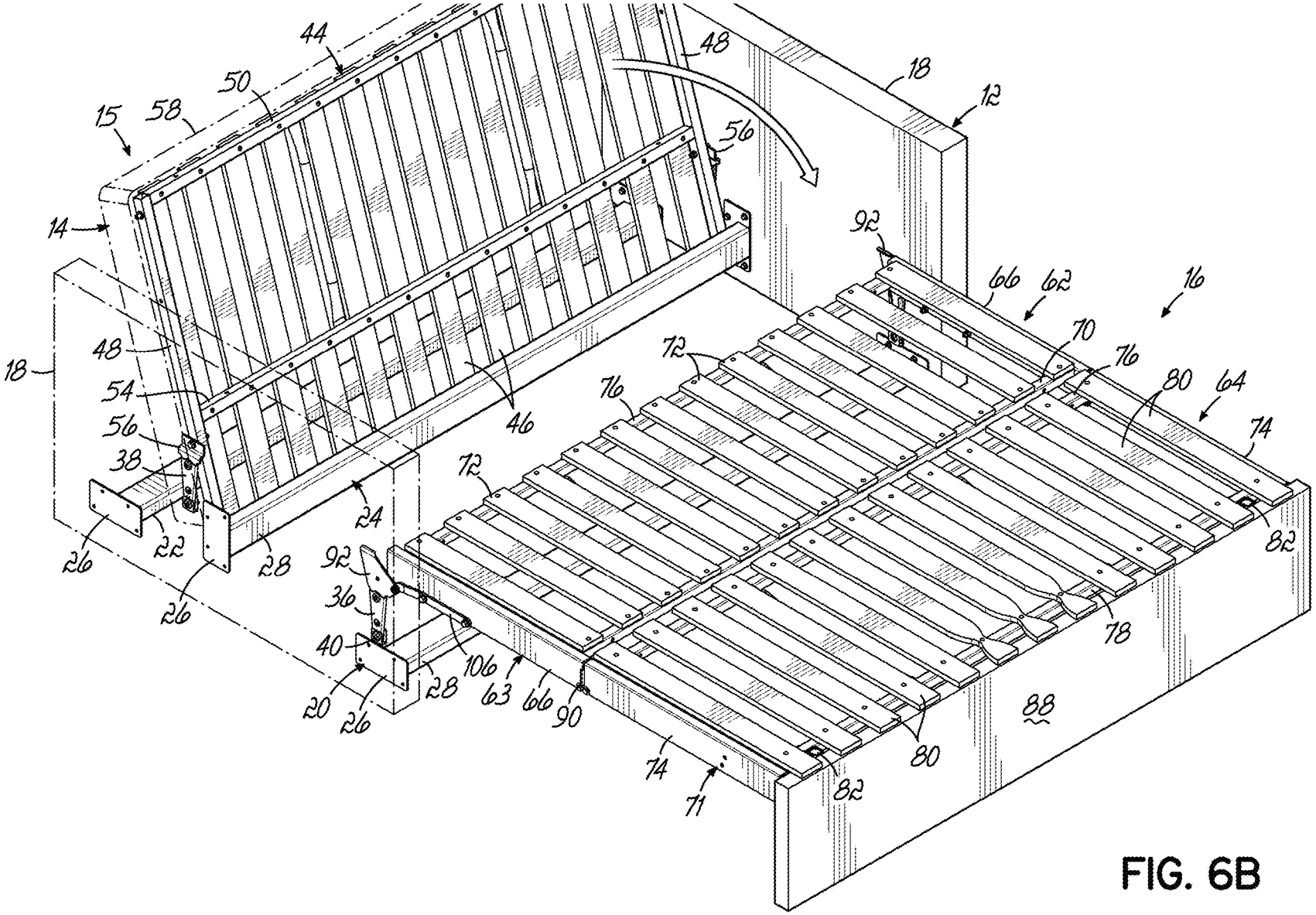
FIG. 6B is a perspective view, partially broken away, of the sofa sleeper of FIG. 6A being further moved from a sofa position to a bed position.
Figure 6C:
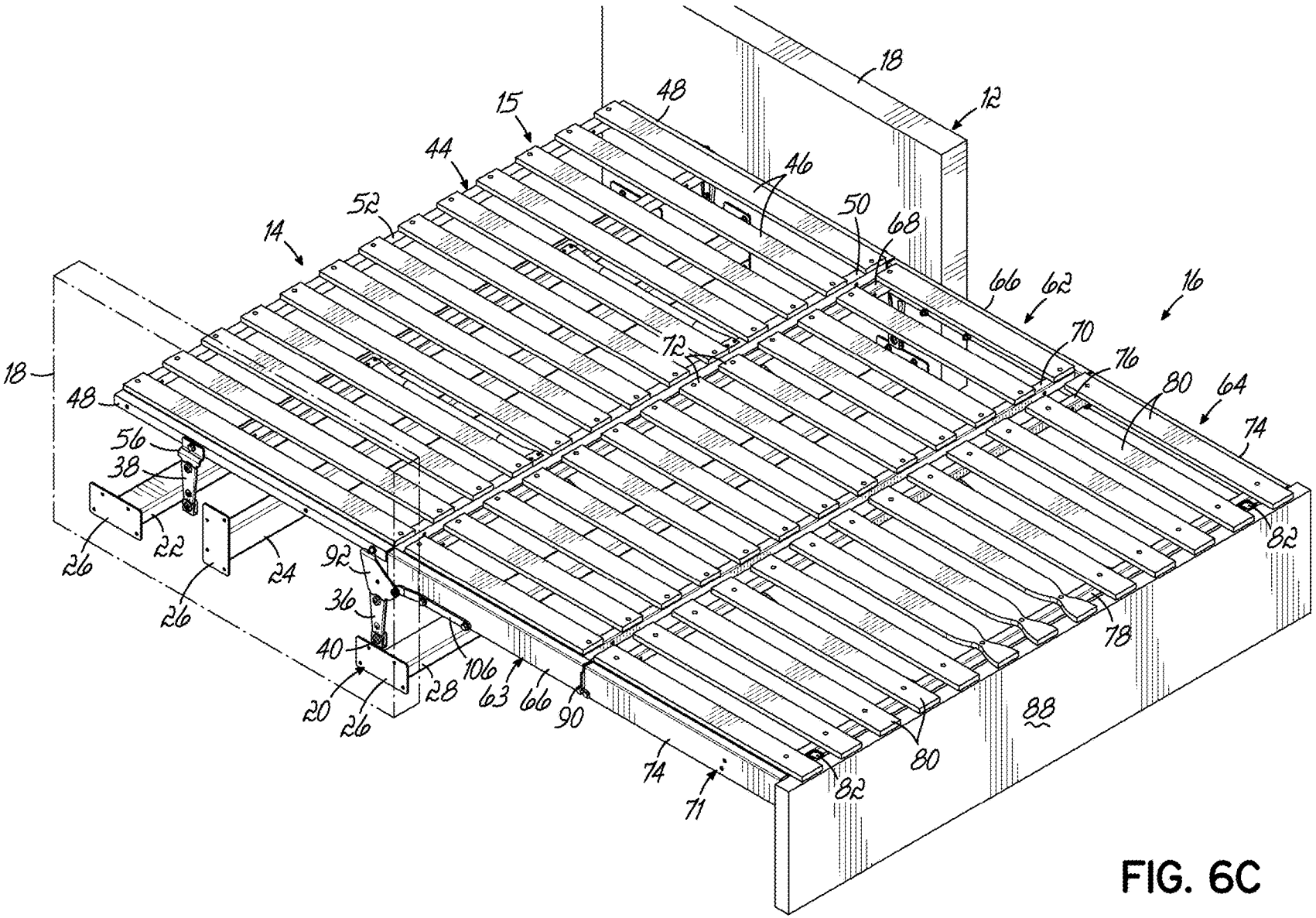
FIG. 6C is a perspective view, partially broken away, of the sofa sleeper of FIG. 6B being in a bed position.
Figure 6D:
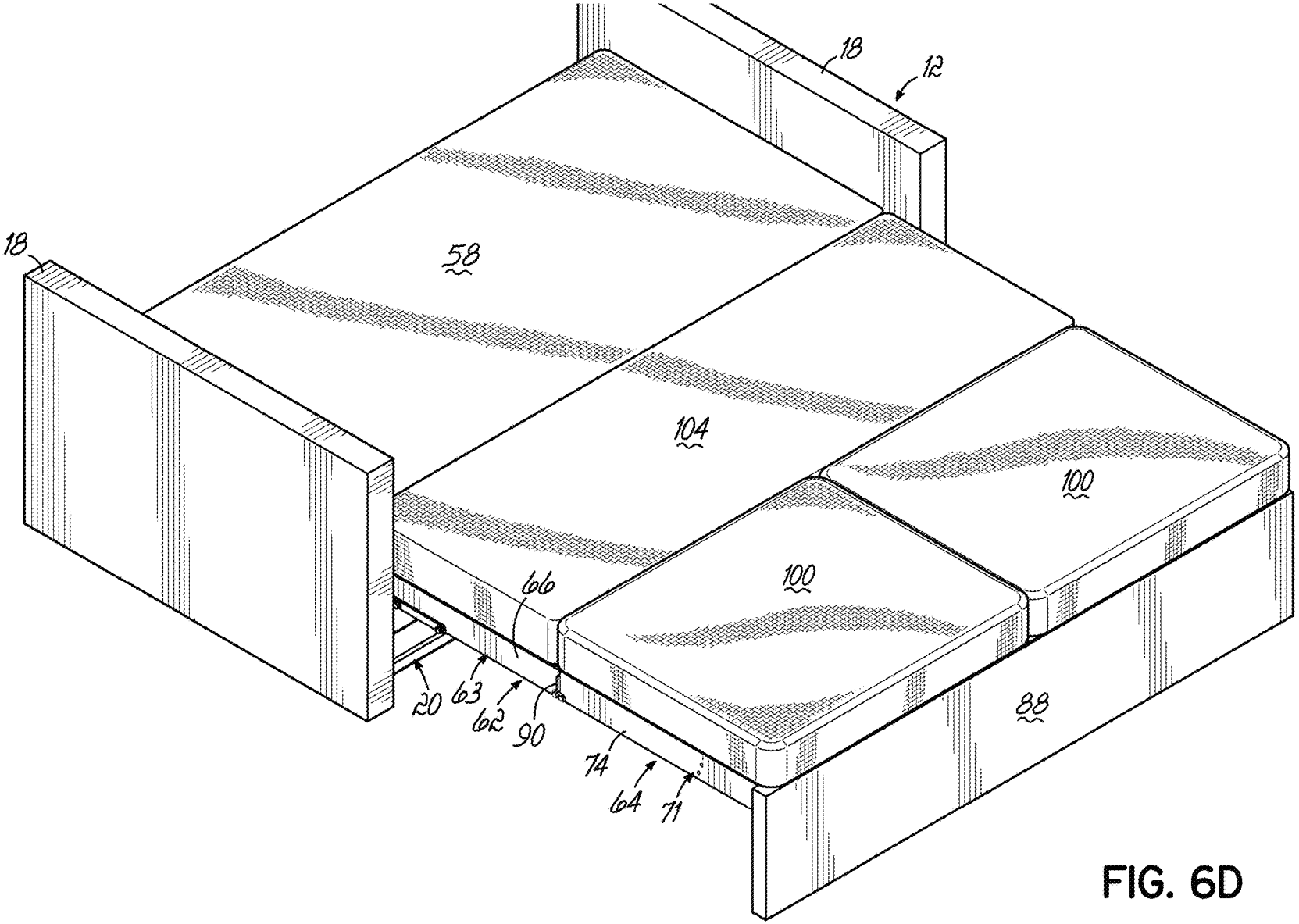
FIG. 6D is a perspective view of the sofa sleeper of FIG. 6C in a bed position with cushions.

The backrest assembly 14 is pivotal between a raised position shown in FIGS. 6A and 6B and a lowered position shown in FIGS. 6C and 6D about pivot axis A. As best shown in FIG. 6A, the backrest assembly 14 further comprises a backrest cushion 58. The backrest cushion 58 is secured to the backrest frame 44 or backrest slats 46 in any known manner. When the backrest assembly 14 is in its raised position, the backrest cushion 58 is behind the backrest slats 46 and backrest frame 44, as seen in FIG. 6B. When the backrest assembly 14 is in its lowered position, the backrest cushion 58 is facing upwardly, as shown in FIG. 6D. The backrest cushion 58 remains attached to the backrest frame 44 or backrest slats 46 regardless of the position of the backrest assembly 14.

Figure 13:
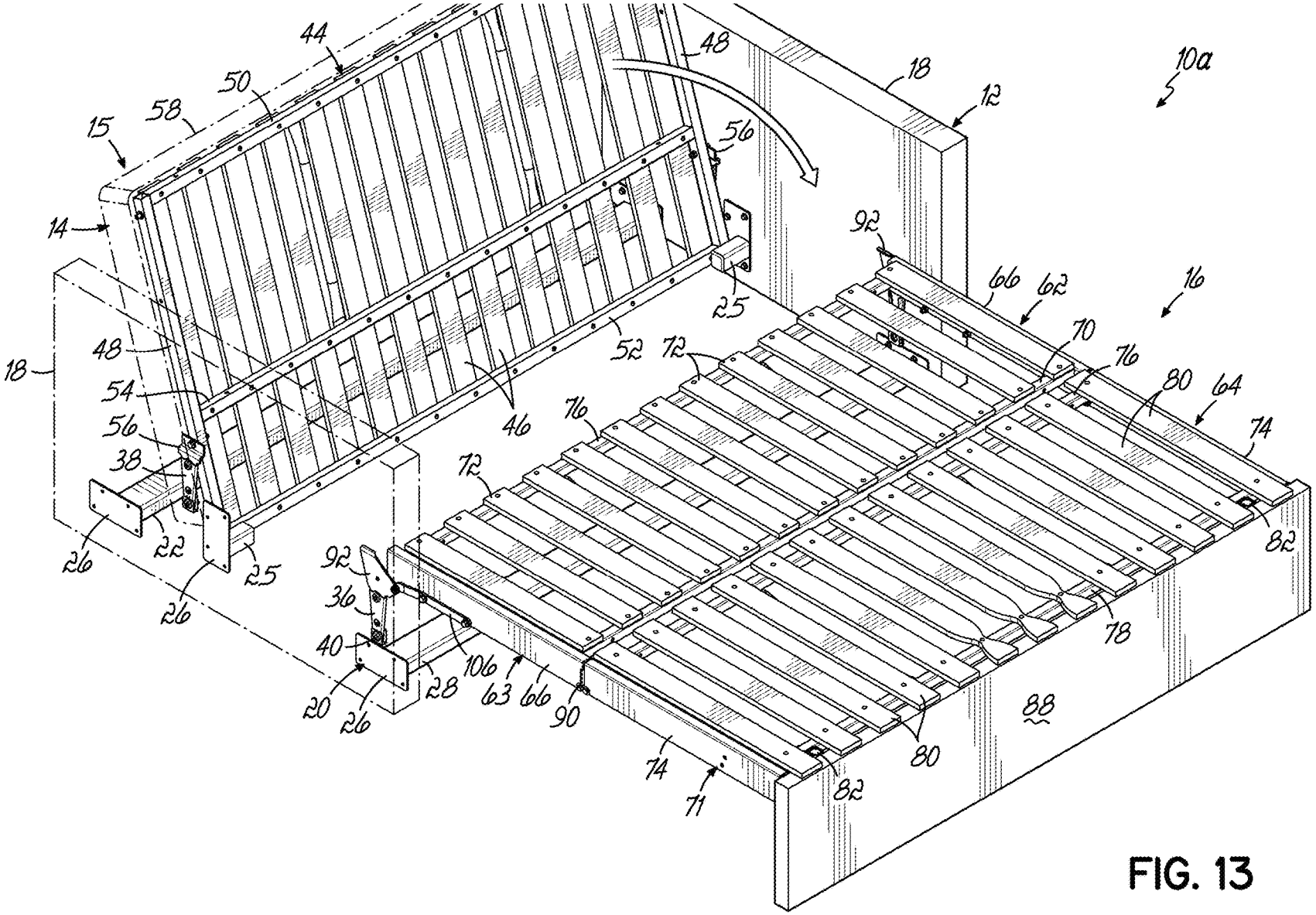
FIG. 13 is a perspective view, partially broken away, of an alternative embodiment of sofa sleeper being moved from a sofa position to a bed position.

As shown in FIGS. 6A and 6B, when the backrest assembly 14 is in its raised position, the backrest bottom member 52 of the generally rectangular backrest frame 44 and lower portions of backrest slats 46 abut the stop 24. Thus, the stop 24 prevents the backrest assembly 14 from pivoting too much about pivot axis A and provides stability when a person is sitting on the sofa sleeper in a sofa position. As shown in FIG. 13, in sofa sleeper 10*a*, in place of a single stop 24 extending between arms 18, two stops 25 may function to keep the backrest assembly 14 in its raised position. Each of the stops 25 is secured to one of the arms 18 with an end plate 26. However, each of the stops 25 may be secured to one of the arms 18 in any known manner. Although shown having an end plate 26, each of the stops 25 may lack an end plate. For example, each of the stops 25 may be a rod extending inwardly from an opening in one of the arms 18. The drawings are not intended to be limiting.

Figure 2:
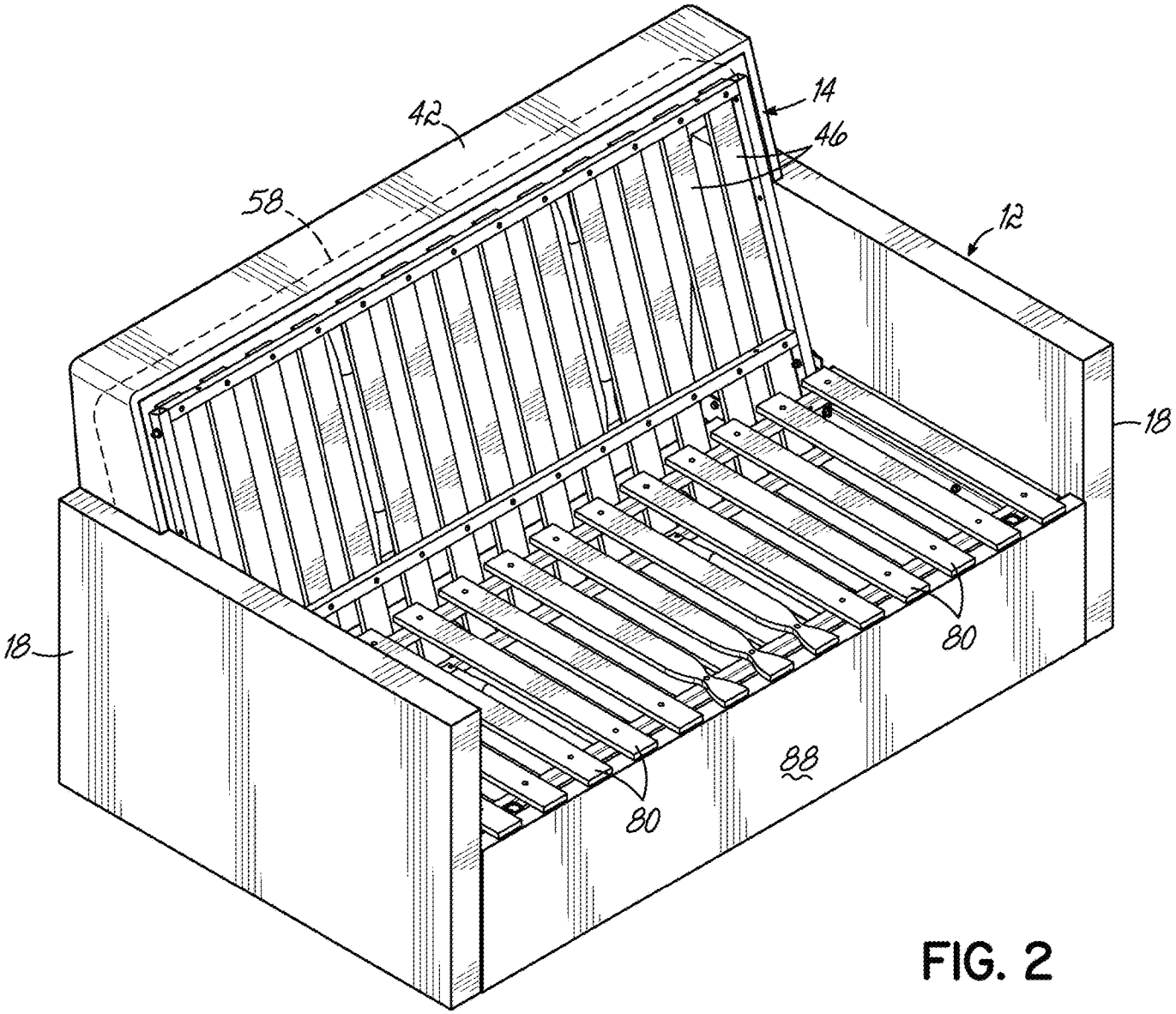
FIG. 2 is a perspective view of the sofa sleeper of FIG. 1 with the cushions removed.

As seen in FIGS. 1 and 2, when the sofa sleeper 10 is in its sofa position, a shell 42 overlays the backrest assembly 14. The shell 42 protects the backrest cushion 58. If desired, the shell 42 may be omitted or may be another size or shape other than as illustrated.

Figure 7A:
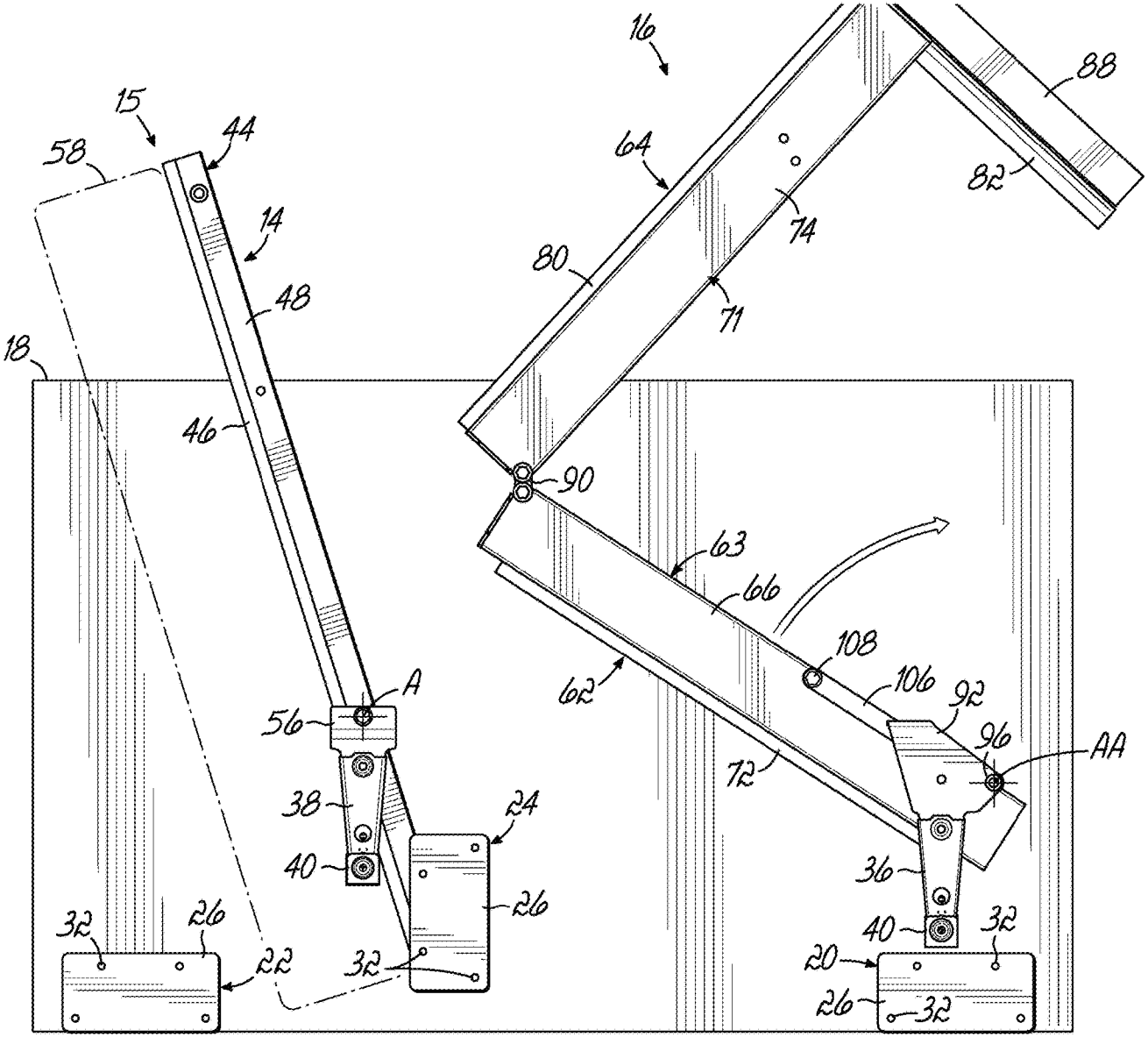
FIG. 7A is a cross-sectional view of the sofa sleeper of FIG. 1, showing the bed mechanism being unfolded.
Figure 7B:
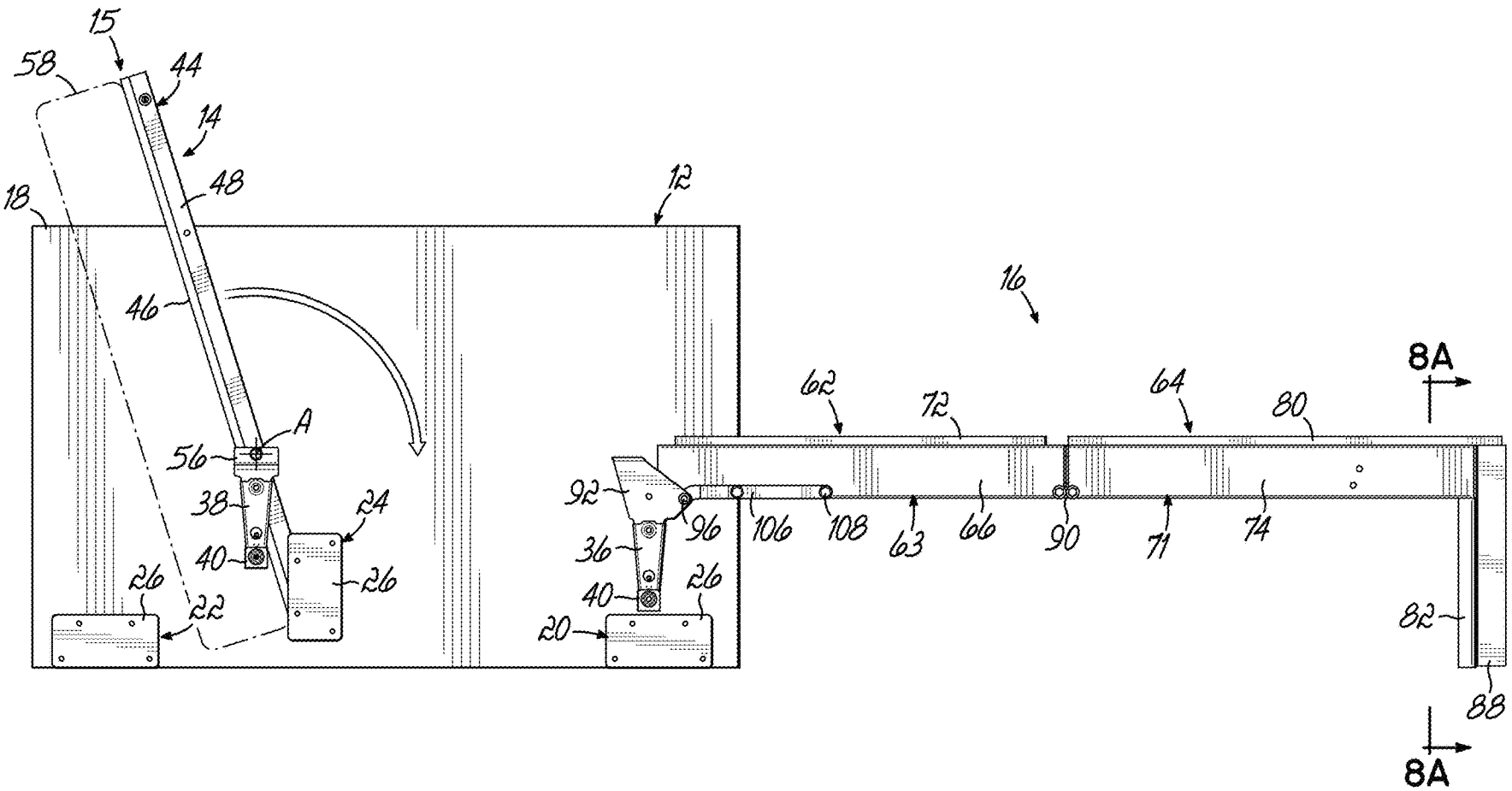
FIG. 7B is a cross-sectional view of the sofa sleeper of FIG. 7A, showing the bed mechanism fully unfolded and the backrest assembly being pivoted from its raised position to its lowered position.
Figure 7C:
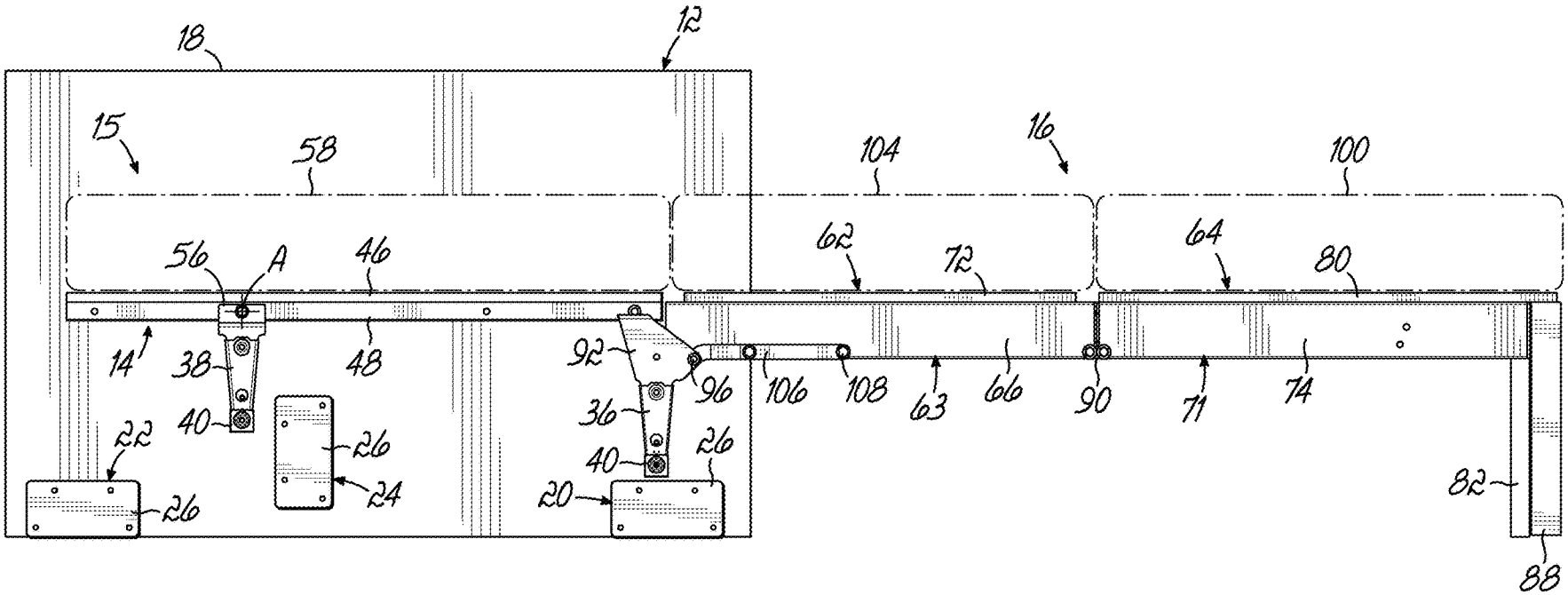
FIG. 7C is a cross-sectional view of the sofa sleeper of FIG. 7B, showing the bed mechanism unfolded and the backrest assembly in its lowered position.

The sofa sleeper 10 further comprises a bed mechanism 16 movable between an extended/unfolded position and a collapsed/folded position. As best shown in FIGS. 7A-7C, the bed mechanism 16 comprises a lumbar section 62 hinged to a foot section 64 with a hinge 90. As best shown in FIGS. 6B and 6C, the lumbar section 62 comprises a lumbar frame 63 comprising two lumbar side members 66, a rear lumbar member 68, a front lumbar member 70 and lumbar slats 72 secured to the rear and front lumbar members 68, 70.

Figure 11:
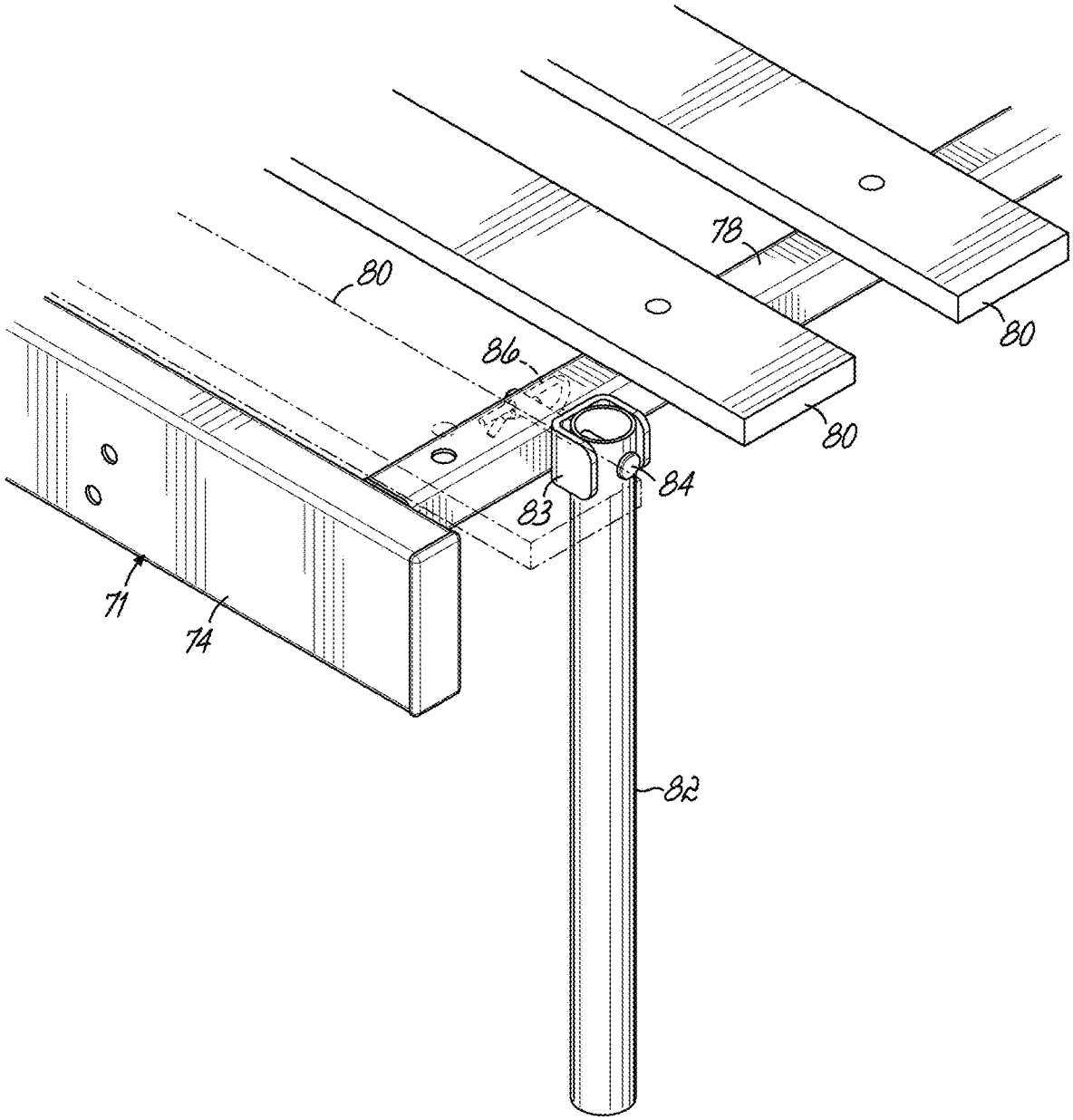
FIG. 11 is a perspective view, partially broken away, of a portion of the sofa sleeper of FIG. 1 showing one of the legs being secured in place.

As best shown in FIGS. 6B and 6C, the foot section 64 comprises a foot frame 71 comprising two foot side members 74, a rear foot member 76, a front foot member 78 and foot slats 80 secured to the rear and front foot members 76, 78. As best shown in FIGS. 7A, 7B and 7C, the foot section 64 further comprises two legs 82 which are secured a bracket 83 shown in FIG. 5A. The bracket 83 is secured to the front foot member 78 of foot section 64. Each leg 82 has aligned holes through which a pin 84 passes to prevent vertical movement of the leg 82. The pin 84 also passes through aligned holes in bracket 83 and through aligned holes in the front foot member 78. The pin 84 is secured in place with a cotter pin 86 as shown in FIGS. 8A, 8B and 11.

The foot section 64 further comprises a protective board 88 secured to the foot side members 74. The protective board 88 remains perpendicular to the foot slats 80 regardless of the position of the bed mechanism 60. Similarly, the legs 82 remain perpendicular to the foot slats 80 regardless of the position of the bed mechanism 16.

Figure 10:
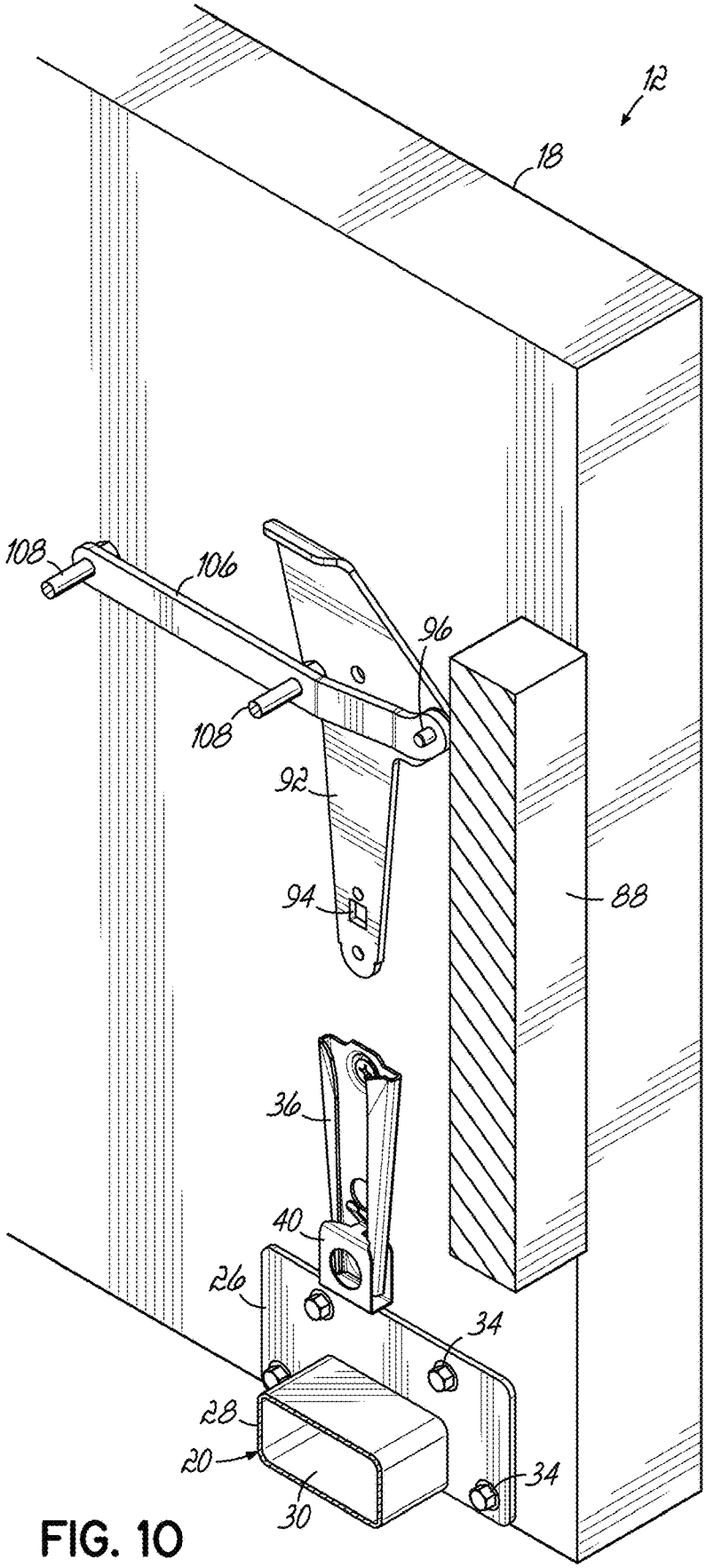
FIG. 10 is a perspective view, partially broken away, of a portion of the sofa sleeper of FIG. 1.

As best shown in FIG. 5A, the lumbar section 62 of the bed mechanism 16 further comprises two front tapered posts 92 (only one being shown). As best shown in FIG. 5A, each front tapered post 92 is adapted to fit inside one of the front tapered mounting brackets 36 and be locked therein. Each front tapered post 92 is pivotally secured to one of the seat side members 66 of the bed mechanism 16 with a pin 96 to pivot about a pivot axis AA shown in FIG. 5A. As best shown in FIG. 5A, a pivot link 106 is secured to each seat side member 66 (only one being shown) with a fastener 108 at one end and with pin 96 at the other end. As shown in FIG. 10, because the pivot link 106 is not straight, the pivot link 106 functions to space the seat side member 66 from the arm 18 of the sofa frame 12 to achieve free movement of the bed mechanism 16 between positions.

As best shown in FIG. 5A, each front tapered post 92 has an opening 94 therein. As best shown in FIGS. 8A and 8B, a portion of the clip 40 fits into the opening 94 of the front tapered post 92 to lock the front tapered post 92 inside the front tapered mounting bracket 36. The same locking mechanism secures each rear tapered post 56 inside one of the rear tapered mounting brackets 38. The front tapered posts 92 secure the bed mechanism 16 to the arms 18 of the sofa frame 12 and enable the bed mechanism to pivot between its collapsed and extended positions described herein.

As best seen in FIG. 1, the sofa sleeper 10 further comprises two seat cushions 100 and two backrest cushions 102. As seen in FIG. 6D, when the sofa sleeper 10 is in its bed position, the seat cushions 100 may be placed over the foot section 64 of the bed mechanism 60. As shown in FIG. 6D, a unitary cushion 104 may be used to cover the lumbar section 62 of the bed mechanism 60. Alternatively, the back cushions 102 may be placed over the lumbar section 62 of the bed mechanism 16. The unitary cushion 104 may be attached to the lumbar section 62 of the bed mechanism 60 or stored under the sofa sleeper 10 until needed. Similarly, the seat cushions 100 may be secured to the foot section 64 of the bed mechanism or unsecured and used only when needed. Any of the cushions 100, 102, 104 may be attached or unattached to the sofa sleeper 10. In order to pivot the backrest assembly 14 about pivot axis A from its raised position to its lowered position, the backrest cushions 102 must be removed.

As best shown in FIGS. 3 and 4, the backrest assembly 14 and the bed mechanism 16 are independently attachable to the arms of the sofa frame 12. Similarly, the backrest assembly 14 and the bed mechanism 16 are independently detachable from the arms of the sofa frame 12.

Figure 12:
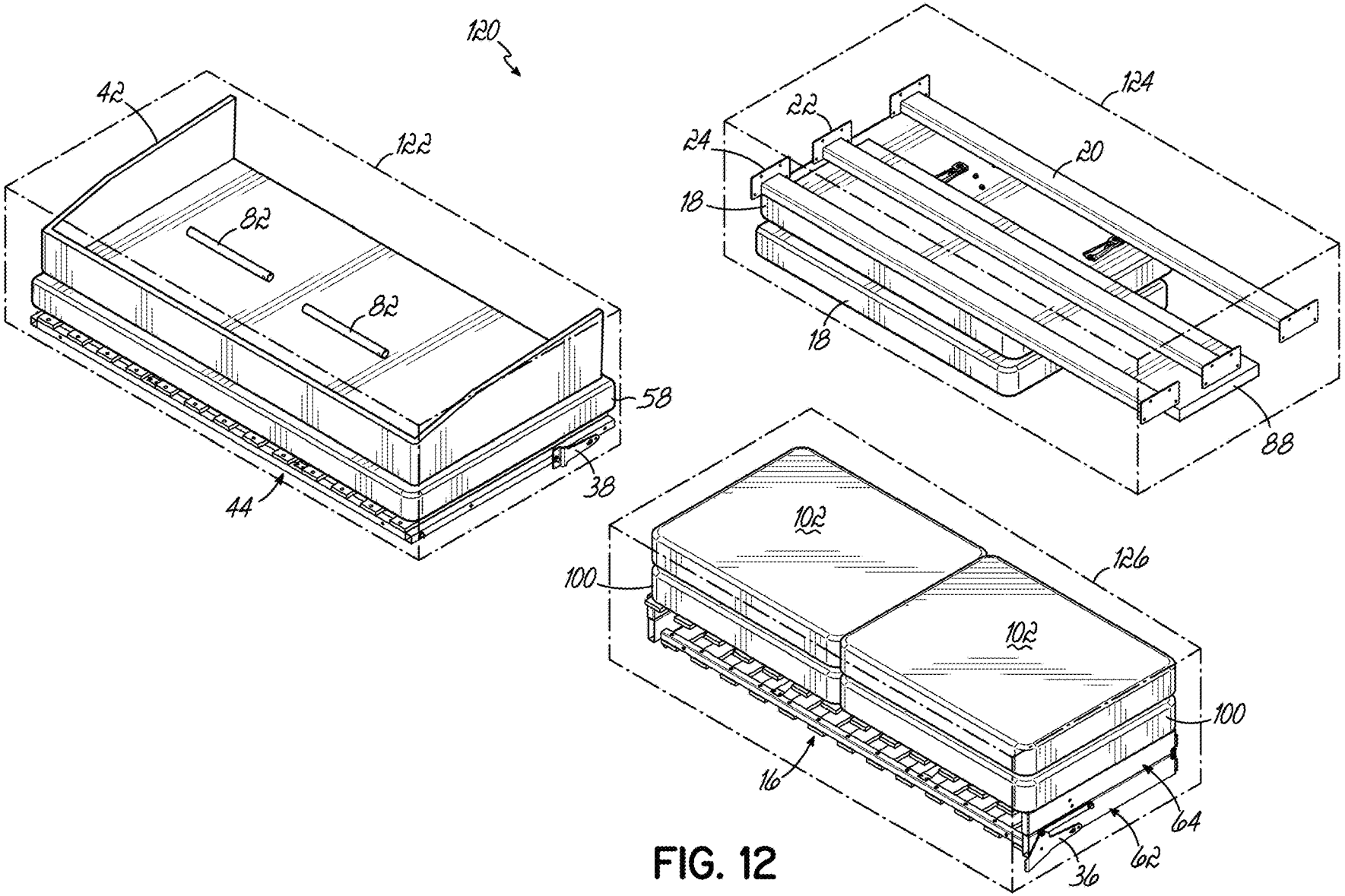
FIG. 12 is a schematic view of a representative shipping assembly for shipping the sofa sleeper.

FIG. 12 illustrates a shipping assembly 120 comprising three boxes 122, 124 and 126. Although the parts of the sofa sleeper are shown in three boxes, they may be in any number of boxes. The components of the sofa sleeper are not intended to be limited to being grouped as shown; they may be grouped in any desired manner. The drawings are not intended to be limiting.

Figure 14:
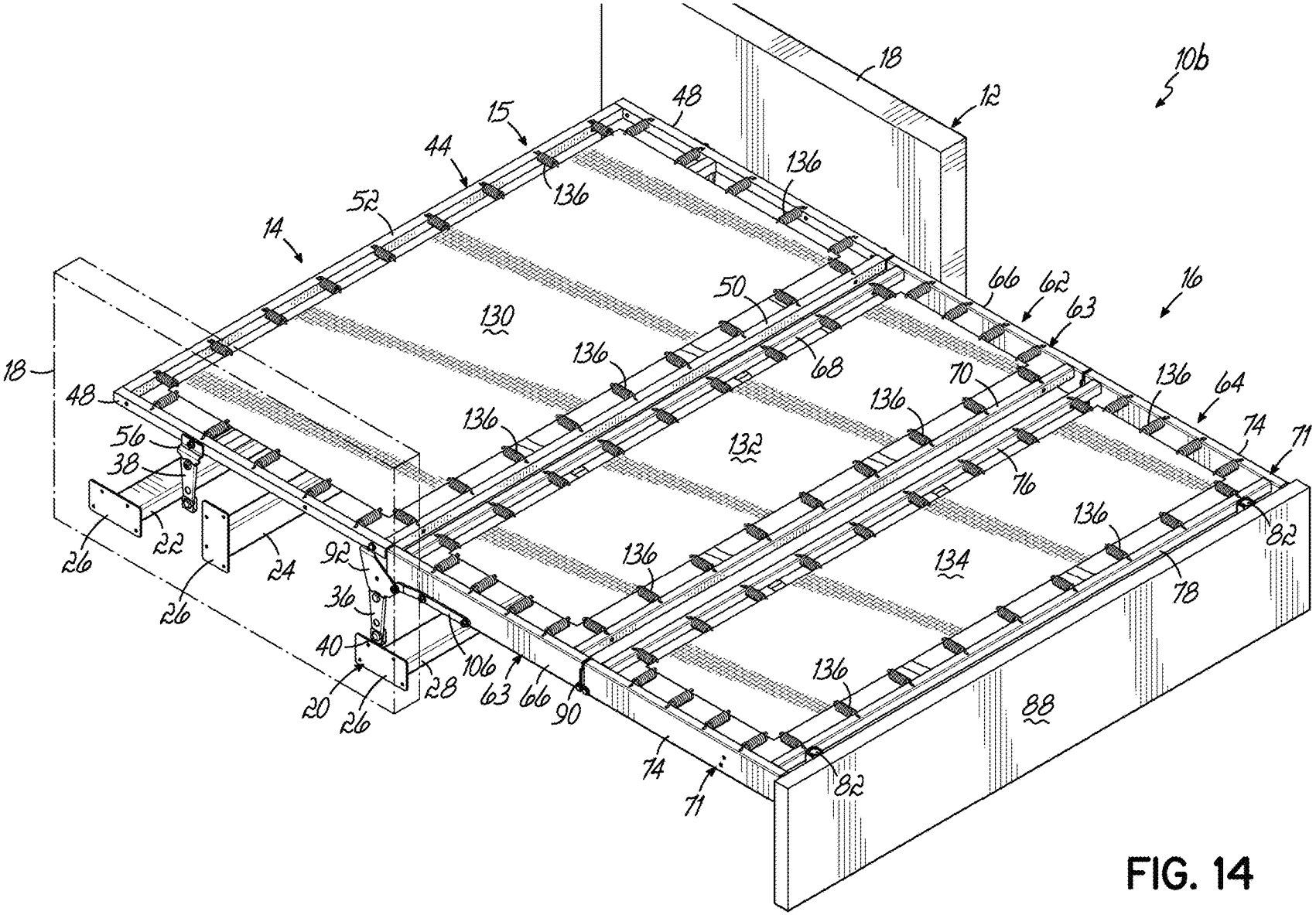
FIG. 14 is a perspective view, partially broken away, of another embodiment of sofa sleeper being in a bed position.

FIG. 14 shows another embodiment of sofa sleeper 10*b* in its bed position. In place of backrest slats 46 in backrest assembly 14 of sofa sleeper 10, a flexible backrest panel 130 is connected to the backrest frame 44 with spaced springs 136. In the lumbar section 62 of sofa sleeper 10*b*, in place of lumbar slats 72 secured to and extending between the rear and front lumbar members 68, 70 of lumbar frame 63, a flexible lumbar panel 132 is connected to the lumbar frame 63 with spaced springs 136. In the foot section 64 of sofa sleeper 10*b*, in place of foot slats 80 secured to and extending between the rear and front foot members 76, 78 of foot frame 71, a flexible foot panel 134 is connected to the foot frame 71 with spaced springs 136.

Figure 15:
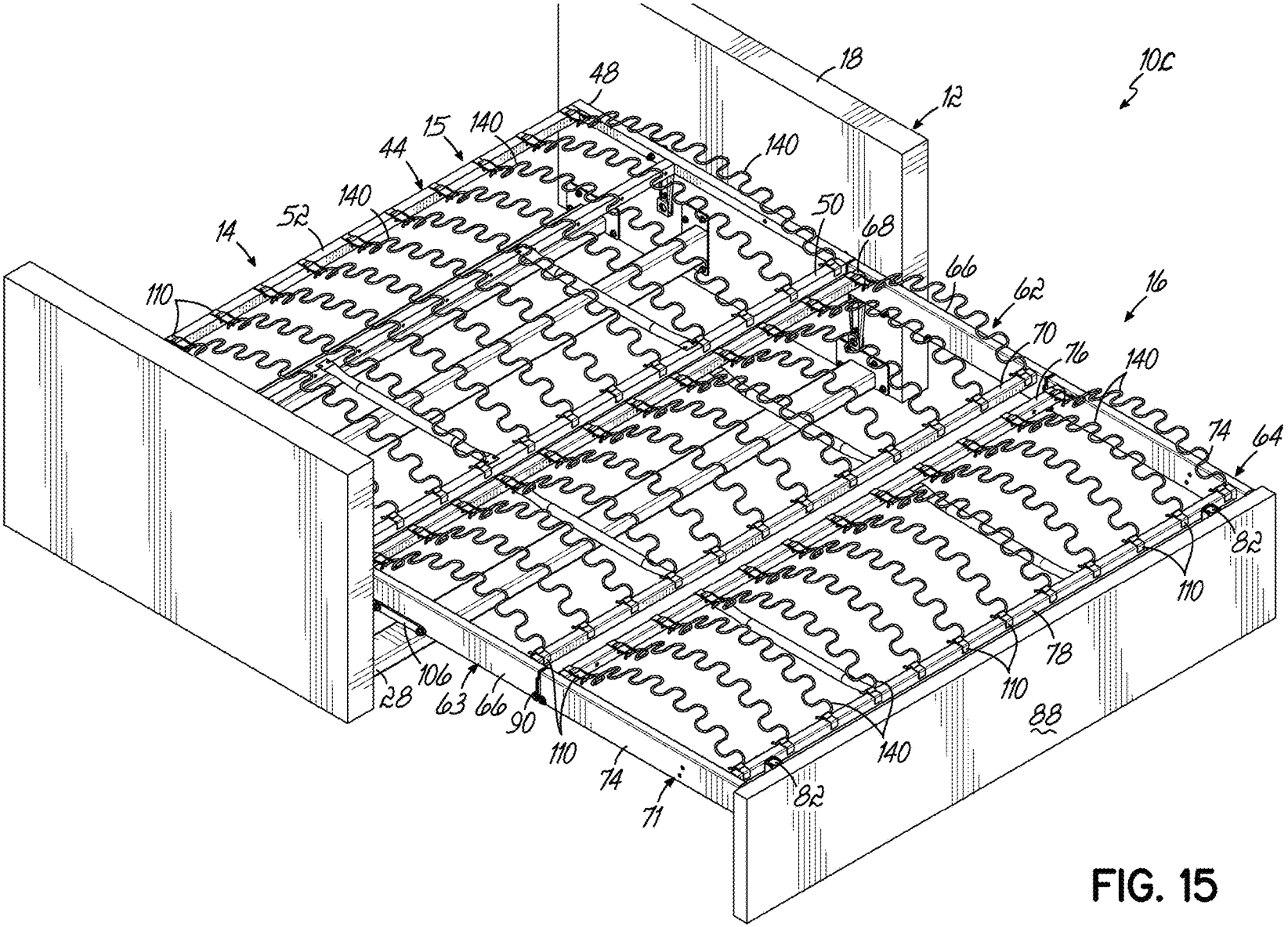
FIG. 15 is a perspective view, partially broken away, of another embodiment of sofa sleeper being in a bed position.

FIG. 15 shows another embodiment of sofa sleeper 10*c* in its bed position. In place of backrest slats 46 in backrest assembly 14 of sofa sleeper 10, spaced arcuate sinuous springs 140 are connected to the backrest top and bottom members 50, 52 of backrest frame 44 with metal clips 110. The spaced arcuate sinuous springs 140 extend between the backrest top and bottom members 50, 52 of backrest frame 44. In the lumbar section 62 of sofa sleeper 10*c*, in place of lumbar slats 72 secured to and extending between the rear and front lumbar members 68, 70 of lumbar frame 63, additional arcuate sinuous springs 140 are connected to the rear and front lumbar members 68, 70 of the lumbar frame 63 with metal clips 110. In place of foot slats 80 secured to and extending between the rear and front foot members 76, 78 of foot frame 71, additional arcuate sinuous springs 140 are connected to the rear and front foot members 76, 78 of foot frame 71 with metal clips 110 in sofa sleeper 10*c*.

Figure 16:
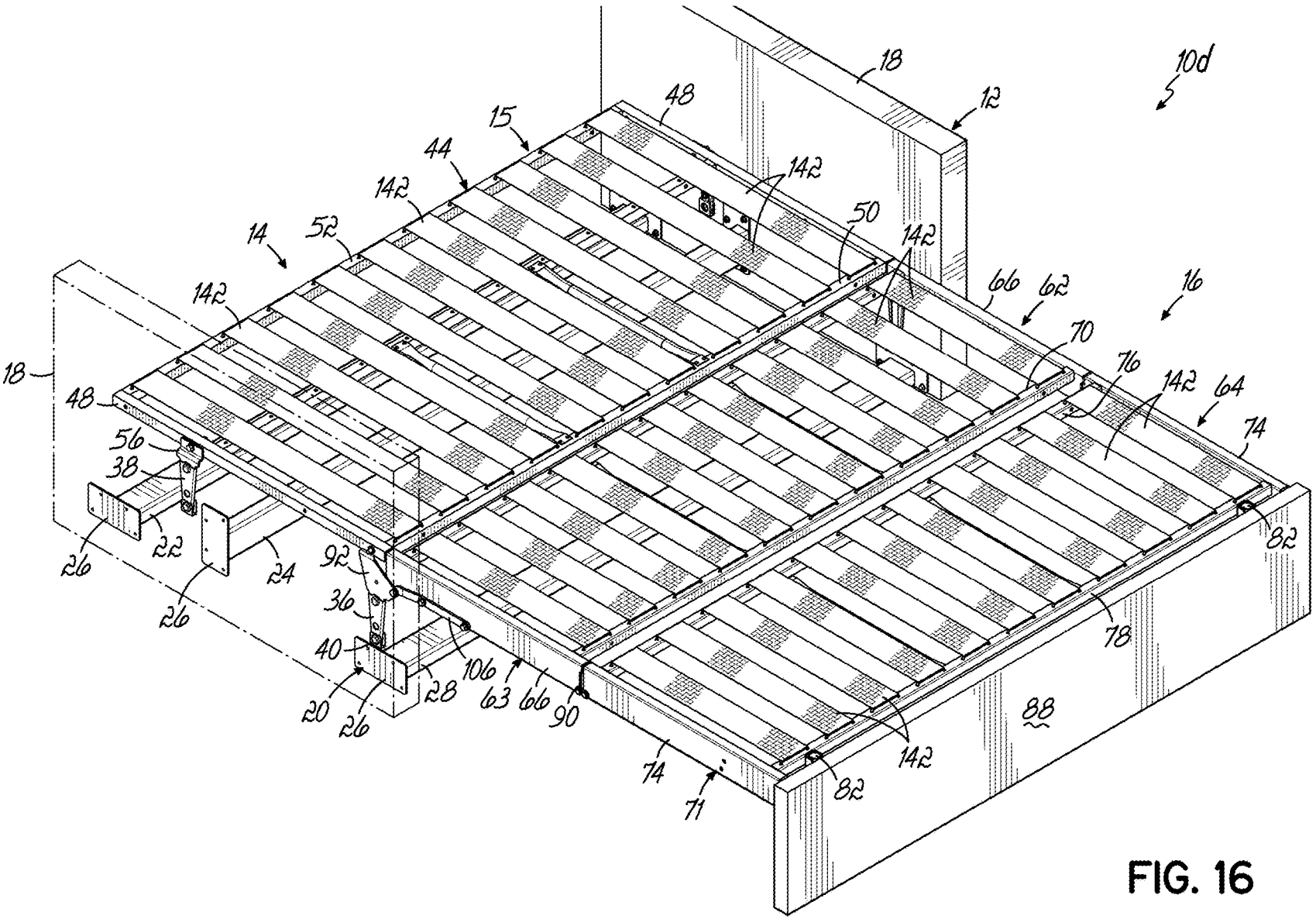
FIG. 16 is a perspective view, partially broken away, of another embodiment of sofa sleeper being in a bed position.

FIG. 16 shows another embodiment of sofa sleeper 10*d* in its bed position. In place of backrest slats 46 in backrest assembly 14 of sofa sleeper 10, spaced flexible straps 142 are connected to the backrest top and bottom members 50, 52 of backrest frame 44 in any known manner. The spaced flexible straps 142 extend between the backrest top and bottom members 50, 52 of backrest frame 44. In the lumbar section 62 of sofa sleeper 10*d*, in place of lumbar slats 72 secured to and extending between the rear and front lumbar members 68, 70 of lumbar frame 63, additional flexible straps 142 are connected to the rear and front lumbar members 68, 70 of the lumbar frame 63 in any conventional manner. In place of foot slats 80 secured to and extending between the rear and front foot members 76, 78 of foot frame 71, additional flexible straps 142 are connected to the rear and front foot members 76, 78 of foot frame 71 in any known manner in sofa sleeper 10*d*.

Although not shown, one of the three sections (backrest section, lumbar section and foot section) may include supports such as slats, flexible straps or flexible panel(s) while another section may include different supports. For example, the backrest assembly may have a flexible panel while the lumbar and foot sections each have slats. In another example, the backrest assembly may include slats while the lumbar and foot sections may have flexible panels. Any combination of slats, flexible straps and flexible panels may be used in any sofa sleeper shown or described herein.

The various embodiments of the invention shown and described are merely for illustrative purposes only, as the drawings and the description are not intended to restrict or limit in any way the scope of the claims. Those skilled in the art will appreciate various changes, modifications, and improvements which can be made to the invention without departing from the spirit or scope thereof. The invention in its broader aspects is therefore not limited to the specific details and representative apparatus and methods shown and described. Departures may therefore be made from such details without departing from the spirit or scope of the general inventive concept. The invention resides in each individual feature described herein, alone, and in all combinations of any and all of those features. Accordingly, the scope of the invention shall be limited only by the following claims and their equivalents.

What is claimed is:

1. A modular sofa sleeper comprising:

a sofa frame comprising two arms, a front brace extending between the arms, a rear brace extending between the arms and a stop extending between the arms between the front and rear braces;

front and rear tapered mounting brackets secured to each of the arms;

a backrest assembly movable between a raised position and a lowered position, the backrest assembly comprising two backrest side members, a backrest top member, a backrest middle member and a backrest bottom member, the backrest assembly further comprising spaced backrest slats secured to the backrest top, middle and bottom members;

rear tapered posts adapted to fit inside the rear tapered mounting brackets, each of the rear tapered posts being pivotally secured to one of the side members of the backrest assembly; and a bed mechanism comprising a foot section and a lumbar section hinged together, the bed mechanism being movable between an extended position and a collapsed position in which the foot section is above the lumbar section;

stationary legs secured to the foot section;

front tapered posts adapted to fit inside the front tapered mounting brackets, each of the front tapered posts being pivotally secured to the lumbar section of the bed mechanism;

wherein said backrest assembly may be removed from the sofa frame by removing said rear tapered posts from said rear tapered mounting brackets and said bed mechanism may be removed from the sofa frame by removing said front tapered posts from said front tapered mounting brackets.

2. The modular sofa sleeper of claim 1 wherein the backrest assembly and bed mechanism may be independently removed from the sofa frame.

3. The modular sofa sleeper of claim 1, wherein the lumbar section of the bed mechanism comprises two seat side members, a seat front member extending between the seat side members and a seat rear member extending between the seat side members.

4. The modular sofa sleeper of claim 1, wherein foot section of the bed mechanism comprises two foot side members, a foot front member extending between the foot side members and a foot rear member extending between the foot side members.

5. The modular sofa sleeper of claim 1, wherein said rear mounting brackets are stationary regardless of the position of the backrest assembly.

6. The modular sofa sleeper of claim 1, wherein said front mounting brackets are stationary regardless of the position of the bed mechanism.

7. The modular sofa sleeper of claim 1, further comprising at least one seat cushion and at least one foot cushion.

8. A modular sofa sleeper comprising:

a sofa frame comprising two arms, a front brace extending between the arms, a rear brace extending between the arms and at least one stop;

front and rear mounting brackets secured to each of the arms;

a pivotal backrest assembly movable between a raised position and a lowered position, wherein said pivotal backrest assembly abuts the at least one stop of the sofa frame when the pivotal backrest assembly is in the raised position;

rear posts pivotally secured to the pivotal backrest assembly, each of the rear posts being adapted to fit inside one of the rear mounting brackets, a bed mechanism comprising a foot section and a lumbar section hinged together, the bed mechanism being movable between an extended position and a collapsed position;

front posts adapted to fit inside the front mounting brackets, each of the front posts being pivotally secured to the bed mechanism;

wherein said pivotal backrest assembly is removable from the sofa frame by removing said rear posts from said rear mounting brackets and said bed mechanism is removable from the sofa frame by removing said front posts from said front mounting brackets.

9. The modular sofa sleeper of claim 8, wherein the pivotal backrest assembly comprises two backrest side members, a backrest top member, a backrest middle member and a backrest bottom member, the backrest assembly further comprising spaced backrest slats secured to the backrest top, middle and bottom members of the backrest.

10. The modular sofa sleeper of claim 8, further comprising legs secured to the foot section, the legs remaining extended regardless of the position of the sofa sleeper.

11. The modular sofa sleeper of claim 8, wherein the foot section is above the lumbar section when the bed mechanism is in the collapsed position.

12. The modular sofa sleeper of claim 8, wherein said pivotal backrest assembly and said bed mechanism are each independently removable from the sofa frame.

13. The modular sofa sleeper of claim 8, wherein the pivotal backrest assembly includes a backrest cushion such that when said pivotal backrest assembly is in its lowered position, the backrest cushion is above the backrest slats.

14. The modular sofa sleeper of claim 8, wherein the pivotal backrest assembly includes a backrest cushion such that when said pivotal backrest assembly is in its lowered position, the backrest cushion faces upwardly.

15. The modular sofa sleeper of claim 8, further comprising at least one seat cushion and at least one foot cushion.

16. A method of assembling a modular sofa sleeper comprising:

providing a sofa frame comprising two arms, a front brace extending between the arms, a rear brace extending between the arms and a stop extending between the arms between the front and rear braces, each of the arms having a front and rear mounting bracket secured to the arm;

securing rear tapered posts of a backrest assembly inside the rear mounting brackets of the sofa frame, each of the rear tapered posts of the backrest assembly being pivotally secured to a side member of the backrest assembly such that the backrest assembly is pivotable between a raised position and a lowered position, wherein the backrest assembly abuts the stop of the sofa frame when the backrest assembly is in the raised position; and securing front tapered posts of a bed mechanism inside the front mounting brackets of the sofa frame, each of the front tapered posts of the bed mechanism being pivotally secured to a lumbar section of the bed mechanism, the bed mechanism further comprising a foot section hinged to the lumbar section, the bed mechanism being movable between an extended position and a collapsed position.

17. The method of claim 16, wherein said method does not require any tools to perform the method.

18. The method of claim 16, wherein sofa frame may be assembled in pieces.

* * * * *